US009254446B2

(12) United States Patent
Lacy et al.

(10) Patent No.: US 9,254,446 B2
(45) Date of Patent: Feb. 9, 2016

(54) SUSPENDED PLAY STRUCTURE

(71) Applicant: Plow & Hearth, LLC, Madison, VA (US)

(72) Inventors: Amanda T. Lacy, Charlottesville, VA (US); Beverly Fries, Barboursville, VA (US); Ting Xu, Richmond, VA (US)

(73) Assignee: PLOW & HEARTH, LLC, Madison, VA (US)

( * ) Notice: Subject to any disclaimer, the term of this patent is extended or adjusted under 35 U.S.C. 154(b) by 0 days.

(21) Appl. No.: 14/322,218

(22) Filed: Jul. 2, 2014

(65) Prior Publication Data

US 2015/0018108 A1 Jan. 15, 2015

Related U.S. Application Data

(60) Provisional application No. 61/842,742, filed on Jul. 3, 2013.

(51) Int. Cl.

| | |
|---|---|
| ***A63G 9/00*** | (2006.01) |
| ***A63H 33/00*** | (2006.01) |
| *E04H 15/04* | (2006.01) |

(52) U.S. Cl.

CPC ..... *A63H 33/008* (2013.01)

(58) Field of Classification Search

CPC ..... A01M 31/00; E04H 15/04; E04H 15/42; E04H 15/44; E04H 15/10; E04H 15/18; E04H 15/06; E04H 15/58

USPC ..... 472/118, 120–125; 5/98.3; 135/87, 90, 135/91, 100

See application file for complete search history.

(56) References Cited

U.S. PATENT DOCUMENTS

| | | | | |
|---|---|---|---|---|
| 2,661,010 | A * | 12/1953 | Powers et al. | 135/121 |
| 3,545,461 | A | 12/1970 | Carlson | |
| 4,526,307 | A | 7/1985 | Parker | |
| 4,825,578 | A * | 5/1989 | Robinson | 43/1 |
| 6,088,953 | A | 7/2000 | Morgan | |
| 7,455,427 | B1 * | 11/2008 | Freeman | 362/249.16 |

FOREIGN PATENT DOCUMENTS

WO WO2009/007740 A1 12/2009

OTHER PUBLICATIONS

Hang-In-Out LLP, Cacoon by hang-in-out, Webpage Capture, Jul. 2, 2014, http://www.hang-in-out.com/.

Hearthsong, HugglePod™ Hanging Chair, Webpage Capture, Jun. 25, 2014, http://www.hearthsong.com/room-play-spaces/hugglepod-indooroutdoor-canvas-hanging-chair.htm.

(Continued)

*Primary Examiner* — Kien Nguyen

(74) *Attorney, Agent, or Firm* — Goodman Allen Donnelly PLLC; Charles M. Allen, Esq.; Mathew R. Osenga, Esq.

(57) ABSTRACT

A suspended play structure includes a floor, a sidewall, and a roof that defines an inner space. The structure includes top and bottom ring structures that provide additional support to the play structure. The play structure can be suspended from a tree, a stand, a ceiling, or similar structure. The structure is collapsible for easy storage and can also include a removable cushion that can fit within an internal pocket. The structure can also include a removable string of LED lights within the inner space.

15 Claims, 37 Drawing Sheets

(56) References Cited

OTHER PUBLICATIONS

Black Diamond Equipment, Cliff Cabana Double Portaledge, Webpage Capture, Jul. 3, 2013, http://blackdiamonequipment.com/en/big-wall-climbing/cliff-cabana-double-portaledge-BD8104510000ALL1.html#q=portaledge&start=2.
DEDON, Nestrest Fact Sheet, PDF Download, Jul. 2, 2013, http://www.dedon.de.
Tentsile, Tentsile Stingray, Webpage Capture, Jul. 2, 2013, http://www.tentsile.com.
Sesungguhnya, Nylon Canvas HugglePodTMHangOut with LED Lights, Blog Post, Jul. 3, 2012, jukardeseman32.blogspot.com/2012/07/nylon-canyas-hugglepodtmhangout-with.html.
Alavi, Farima, Daily Delight: Nestrest Hammock, Blog Post, May 12, 2012, http://blog.hgtv.com/design/2012/05112/daily-delight-nestrest-hammock/.

* cited by examiner

SUSPENDED PLAY STRUCTURE

CROSS-REFERENCE TO RELATED APPLICATION

This application claims the benefit of U.S. Provisional Application No. 61/842,742, filed Jul. 3, 2013, the contents of which are hereby incorporated by reference.

FIELD OF THE INVENTION

The field of the invention generally relates to play structures. More specifically, the invention relates to a play structure designed to be suspended from a support.

BACKGROUND OF THE INVENTION

In the field of children's play structures, many products exist that allow one or more individuals to play within an enclosed structure. Quite often, children will create their own play structures from pillows and chairs in order to create indoor tents or forts. Usually, play structures designed for or created by children are supported from the bottom and not designed to be suspended from above. In such embodiments, the play structure may prove to be un-thrilling and outdated.

One structure, marketed as the Hugglepod™ hanging chair, is quite different from the presently disclosed invention. The hanging chair can only support a single child, while the present invention is intended to support multiple children simultaneously. As described in further detail below, top and bottom rings that are affixed to straps support the structures of the present invention to provide support for the additional weight. The cushion used in the present invention is inserted within an internal floor pocket and is secured with a zipper closure. The larger structure of the present invention permits the addition of a window opening that is not present in the smaller hanging chair. The optional lights can add further decorativeness and usefulness in a dark or night environment of the present invention. These features are described in more detail below.

There is a need for a suspended play structure that can be used indoors and outdoors, is enclosed, can support more than one child, is thrilling and exciting, and can be produced at low cost. There is also a need for a suspended play structure that includes a removable cushion, reinforced nylon strapping, a built in door flap, one or more windows, and removable lights.

SUMMARY OF THE INVENTION

The invention relates to various exemplary embodiments, including articles, structures, play structures, and various methods of using the same.

These and other features and advantages of the invention are described below with reference to the accompanying drawings.

DETAILED DESCRIPTION

Figure 1:
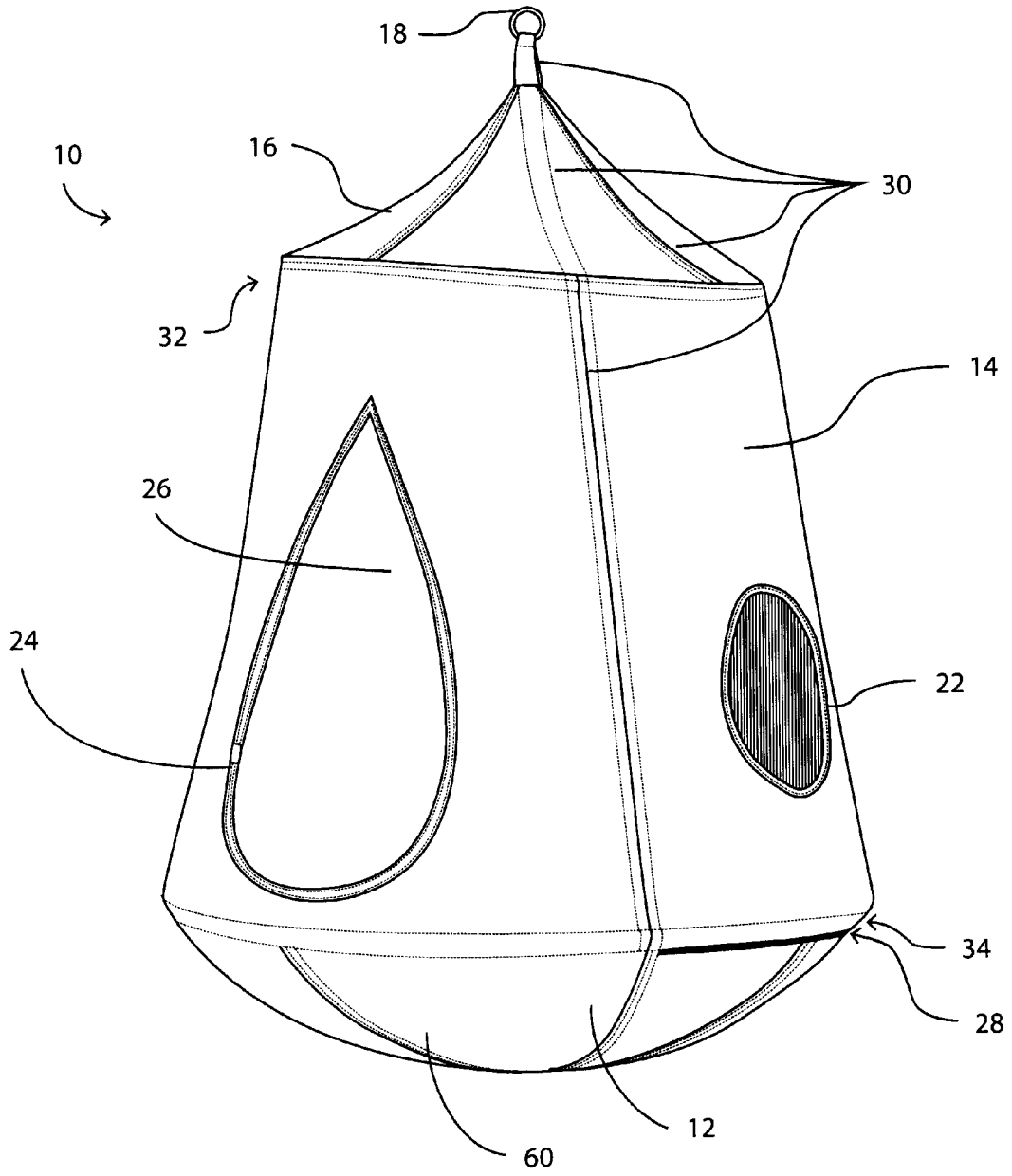
FIG. 1 is a perspective view of the suspended play structure.

The following description is merely exemplary in nature and is not intended to limit the present disclosure, application, or uses. It should be understood that throughout the drawings, corresponding reference numerals indicate like or corresponding parts and features.

Before the present invention is described in further detail, it is to be understood that the invention is not limited to the particular embodiments described, as such may, of course, vary. It is also to be understood that the terminology used herein is for the purpose of describing particular embodiments only, and is not intended to be limiting, since the scope of the present invention will be limited only by the appended claims.

A number of materials are identified as suitable for various aspects of the suspended play structure. These materials are to be treated as exemplary and are not intended to limit the scope of the claims. Although any methods and materials similar or equivalent to those described herein can also be used in the practice or testing of the present invention, a limited number of the exemplary methods and materials are described herein.

It will be understood by those having ordinary skill in the art that the various shapes, openings, and cavities as described herein may be made through any applicable manufacturing technique or combinations of techniques, such as, but not limited to, casting, forging, drawing, turning, welding, cutting, drilling, injecting, reaming, or other techniques, regardless of the terminology used in describing those shapes, openings, apertures, or cavities. Similarly, various attachment methods and connections described herein may be made through any applicable attachment technique or combinations of techniques, such as, but not limited to, sewing, stitching, adhering, welding, clamping, crimping, or other techniques, regardless of the terminology used in describing the attachment method.

Unless otherwise noted, the drawings of the present application are not necessarily drawn to scale. They demonstrate the basic relationship of the constituent parts, but not necessarily their respective sizes.

It must be noted that, as used herein and in the appended claims, the singular forms "a", "an", and "the" include plural referents unless the context clearly dictates otherwise.

Figure 2:
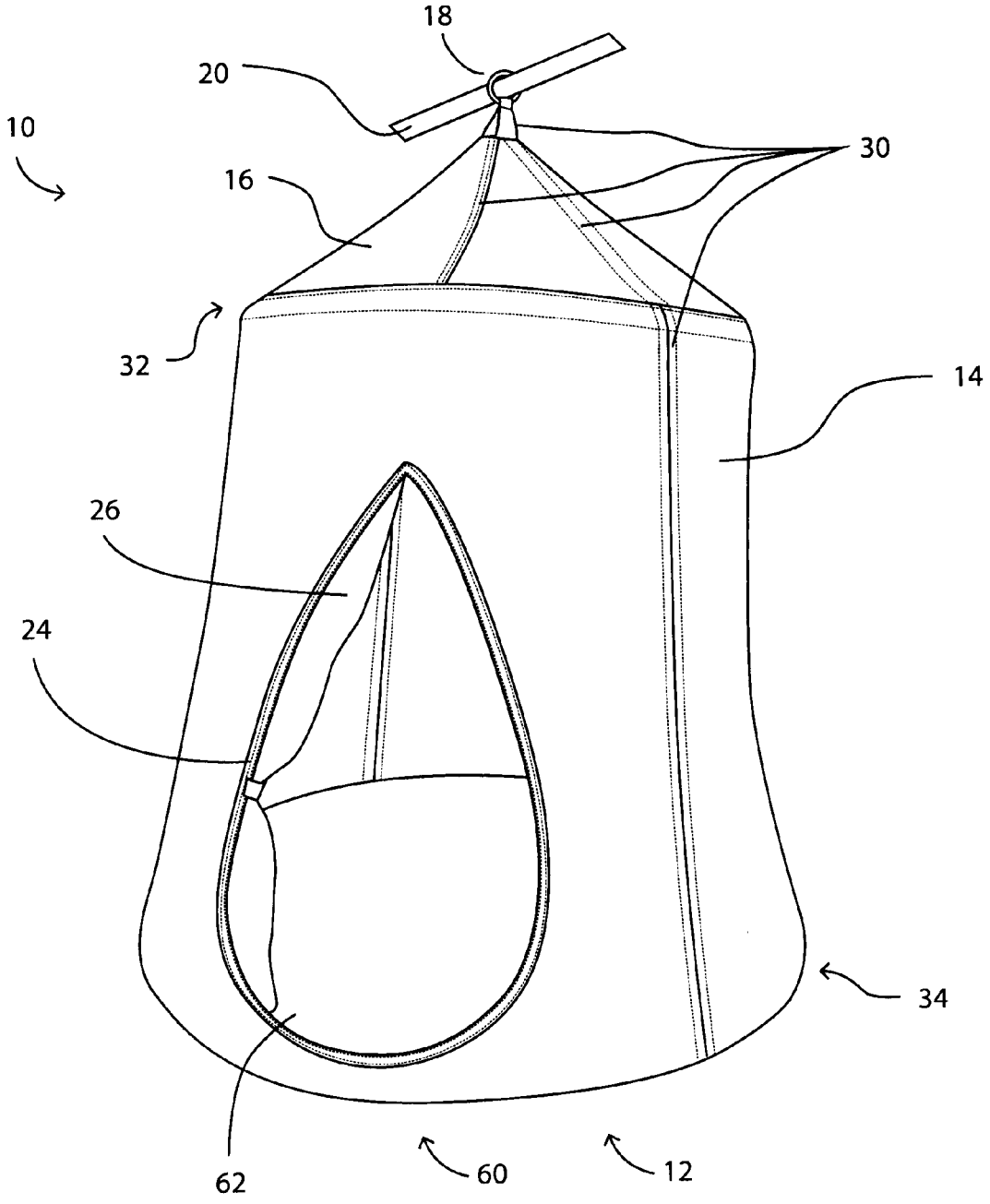
FIG. 2 is a front perspective side view of the suspended play structure of FIG. 1.

Referring to FIGS. 1-2, a suspended play structure 10 is shown. The suspended play structure 10 includes a floor 12, a sidewall 14, and a roof 16. The floor 12, sidewall 14, and roof 16 may individually and collectively be made from one or many pieces of material. As shown in FIG. 1, the sidewall 14 is made from several pieces of material attached together through sewing. The suspended play structure 10 may include support straps 30 embedded within, or attached to, the floor 12, sidewall 14, and/or roof 16. The set of support straps 30 may loop around a hanging ring 18 and continue down the roof 16, down the sidewall 14, and to the floor 12. The support straps 30 may connect to one another within or near the floor 12.

The suspended play structure 10 may be suspended from an external support. In use, the external support 20 may include any support strong enough to support the suspended play structure 10 and any occupants thereof. Exemplary external supports 20 include tree limbs, a stand, a ceiling (e.g., a hook securely attached to joists above the ceiling), or other supports. The stand may be a powder-coated stand that can be supported on the ground. The play structure 10 may be hung from one or more support points by nylon straps and S hooks.

The sidewall 14 may include one or more windows 22. Each window 22 may include a cutout or other hole in the sidewall 14 located approximately 6" to 10" from where the sidewall 14 meets the floor 12. Each window 22 may be oval shaped. The sidewall 14 may also include a doorway 24 through which an individual may enter the interior space of the suspended play structure 10. The doorway 24 may be teardrop shaped as shown, while other doorway shapes are within the scope of the invention. The doorway 24 may include a door flap 26. The door flap 26 may be secured to the sidewall 14 on one side and may be secured in place over the doorway 24 through the use of hook and loop fasteners.

The suspended play structure 10 may include a top ring 32 and a bottom ring 34. The top ring 32 and bottom ring 34 may be made of a strong material, such as metal (e.g., steel, aluminum, or others), and may be substantially covered in a cushioning material, such as foam. The top ring 32 and bottom ring 34 assist in providing additional structural support to the suspended play structure 10. The top ring 32 may be of a narrower diameter than the bottom ring 34. The top ring 32 and bottom ring 34 may be positioned such that the support straps 30 interact with the outer circumferences of the top ring 32 and bottom ring 34 (i.e., the support straps 30 are located farther outside of the center of the suspended play structure 10 than the top ring 32 and bottom ring 34.)

The top ring 32 may be pre-installed and may be a single, solid piece. The bottom ring 34 may be installable by an end user and may come in multiple pieces. In an embodiment, the bottom ring 34 is made of four separable arc-shaped pieces 36 that attach together end-to-end. Each separable arc-shaped piece has a plain first end 38 and a second end with a tubular receptacle 40 sized to fit around the plain first end 38 of an adjacent arc-shaped piece 36. The tubular receptacle includes a set screw 42 configured to provide additional friction to the plain first end of the adjacent arc-shaped piece when the bottom ring 34 is fully assembled. The bottom ring 34 may fit within a set of sleeves located on the inner side of the sidewall 14 or the inner side of the floor 12. The sleeves may include permanent sleeves having openings on a first end and a second end, but otherwise being permanently sewn or otherwise attached to the suspended play structure 10. The sleeves may also include openable sleeves, the openable sleeves being formed of one or more pieces of material having hook and loop fasteners thereon and being able to be positioned around the bottom ring 34 and secured in place with opposing hook and loop fasteners located on either the inner side of the sidewall 14 or the inner side of the floor 12.

Referring to FIGS. 1-2, the floor 12 includes a bottom layer 60 and a top layer 62, thus forming an internal pocket. The internal pocket may be accessible through a zipper closure 28. The internal pocket may be configured to contain an internal cushion 50. The internal cushion 50 may only be accessible through the zipper closure 28. Therefore, when inside suspended play structure 10, the internal cushion 50 would provide support for a user through the top layer 62 of the floor 12.

Inside the suspended play structure 10, attachment points 80 may be located on the sidewall 14 or roof 16 and may be located at the intersection of the sidewall 14 and the roof 16. The attachment points 80 may be made from a loop of hook and loop fastener material that interacts with hook and loop fastener material sewn or otherwise attached to the sidewall 14 and/or roof 16. In this fashion, the attachment points 80 may be used to removably secure accessories. In an embodiment, the attachment points 80 are used to suspend a set of string lights 90. The string lights 90 may include a battery power pack 92, an on/off switch, and a set of LED lights 94.

The suspended play structure 10 may include an accessory pocket 96 into which the battery power pack 92 may be placed and/or secured.

The floor 12, sidewall 14, and roof 16 of the suspended play structure 10 may be made from canvas, or from approximately 100% nylon and may have trim reinforced with nylon. The support straps 30 may be made from nylon webbing. The internal cushion 50 may include approximately 100% polyester filling (e.g., polyfill). The suspended play structure 10 may be capable of holding up to approximately 250 lbs.

In one implementation, the play structure has dimensions of about 54"H×44"W, the stand is about 48"W×48"D×84"H, and the strap is about 100"L×1½"W.

Figure 3:
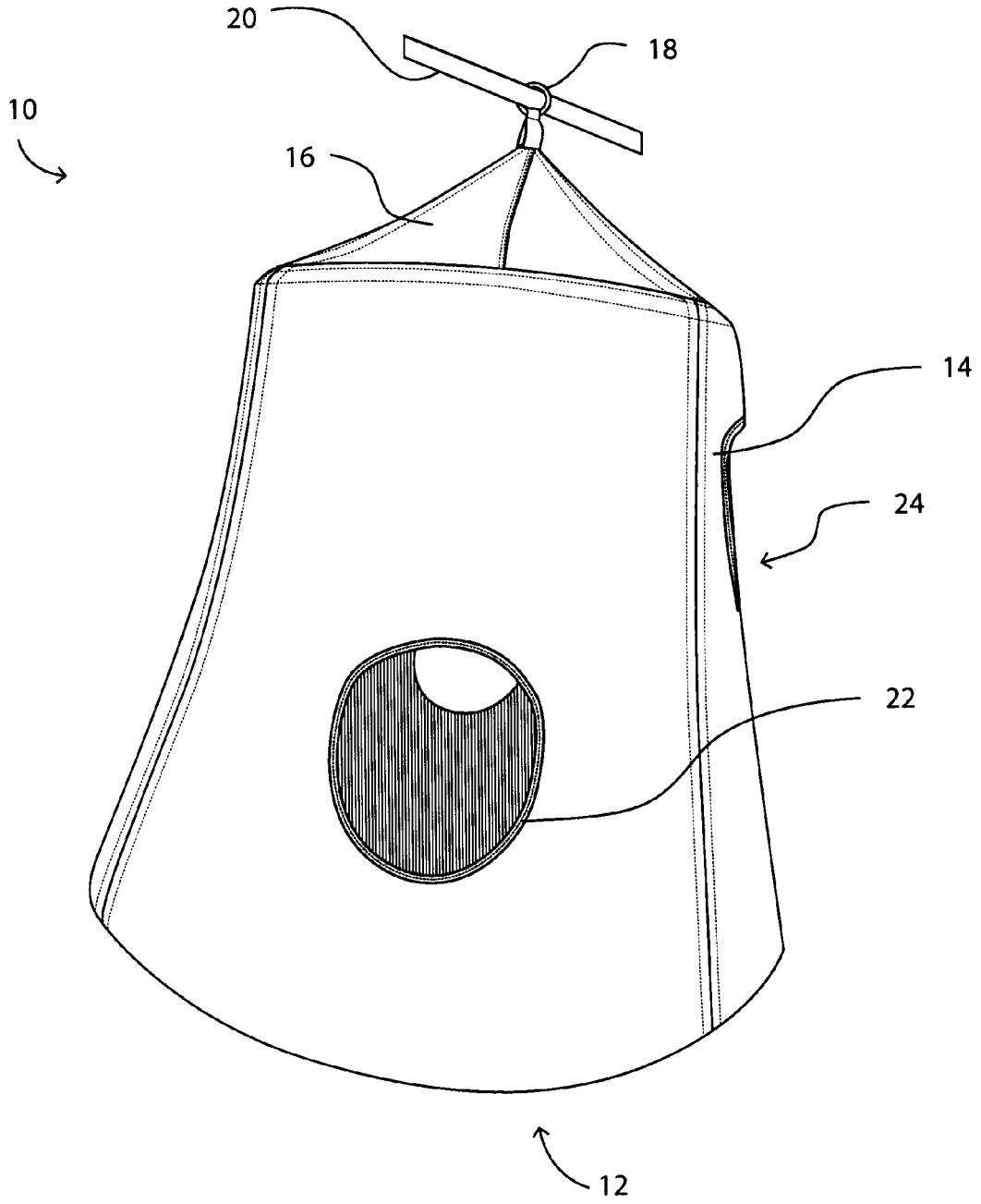
FIG. 3 is a perspective side view of the suspended play structure of FIG. 1.
Figure 4:
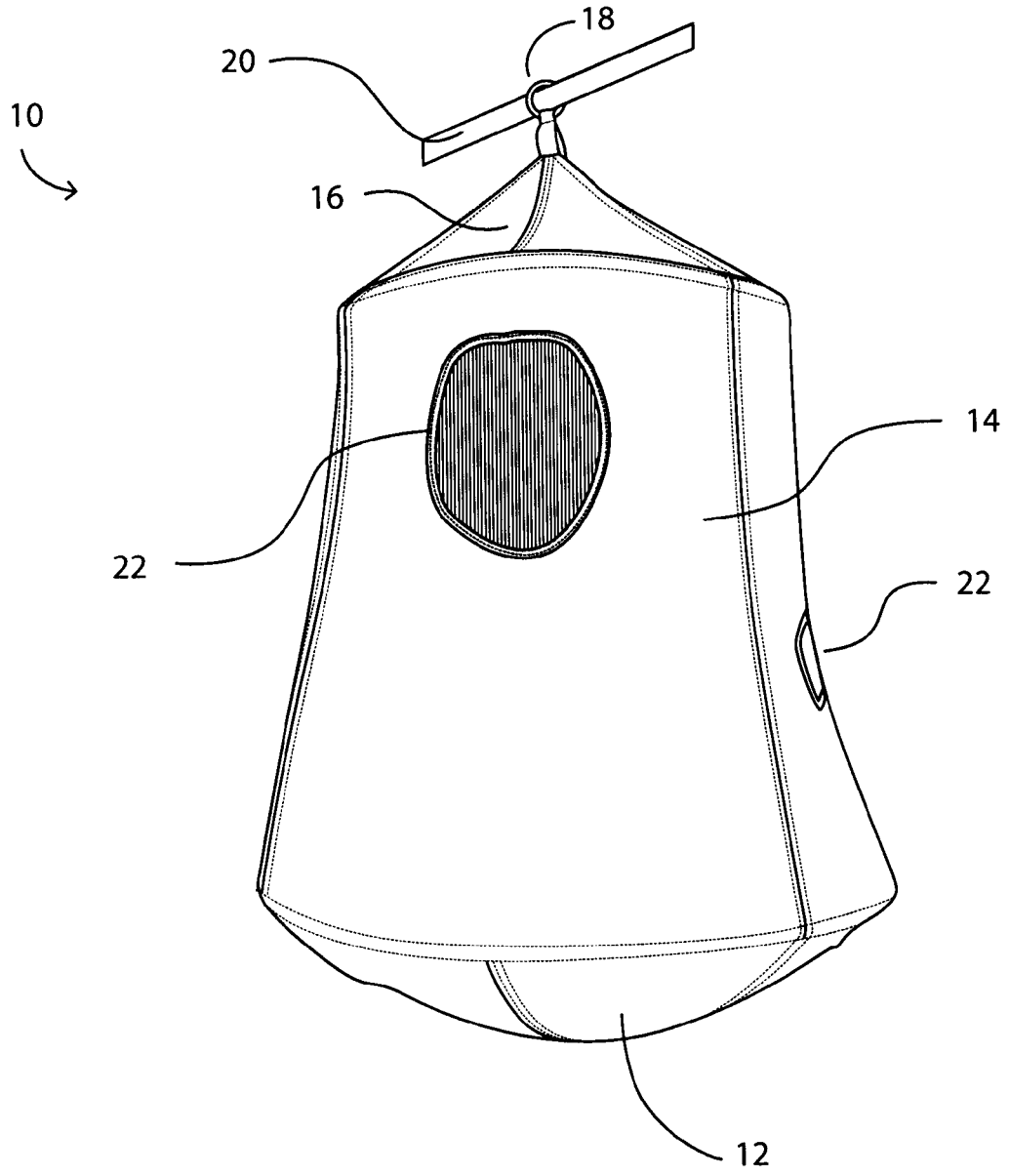
FIG. 4 is a back perspective back to side view of the suspended play structure of FIG. 1.
Figure 5:
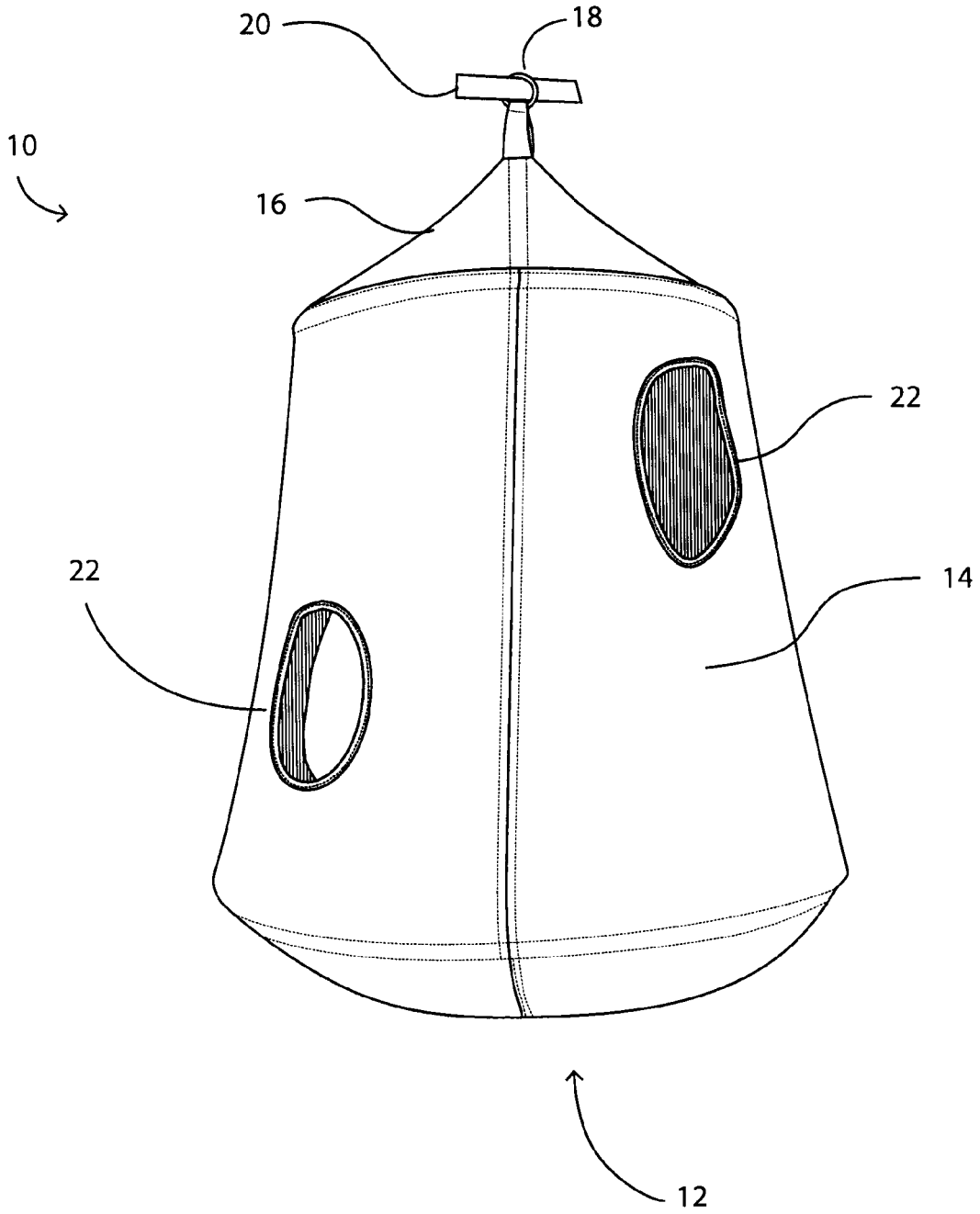
FIG. 5 is a perspective side view of the suspended play structure of FIG. 1.
Figure 6:
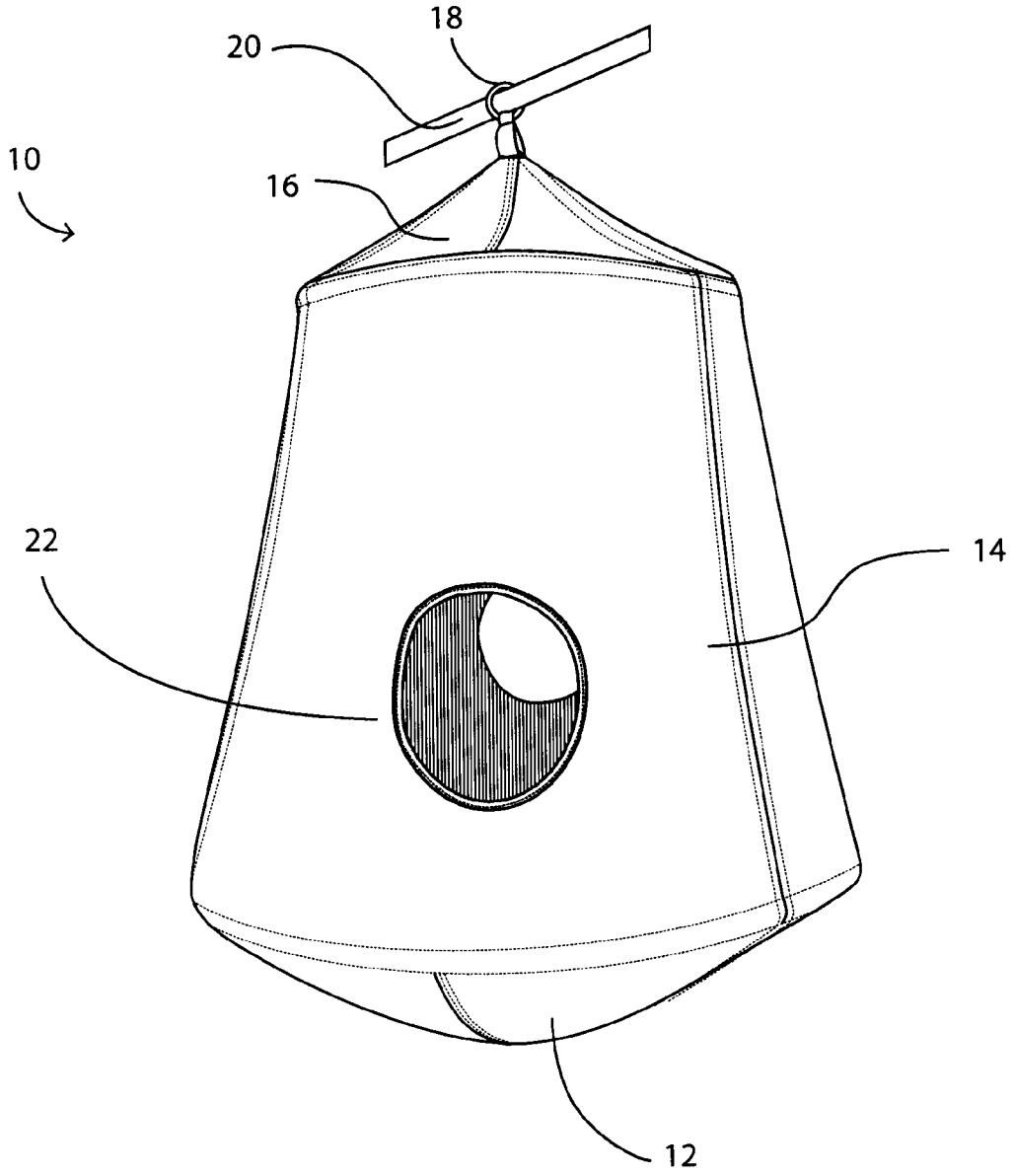
FIG. 6 is a perspective side view of the suspended play structure of FIG. 1.

FIGS. 3-6 show another view of the suspended play structure 10 of the present invention. In this view, window 22 is shown in FIG. 3 to be opposite the doorway 24, deployed in a circular shape. Other shapes of windows are also within the scope of the invention. Hanging ring 18 is shown suspended from hanging support 20. The play structure 10 includes roof 16, sidewall 14, and floor 12. A second window 22 is shown in FIGS. 4-6, as a single or multiple windows 22 may be deployed with the invention.

Figure 7:
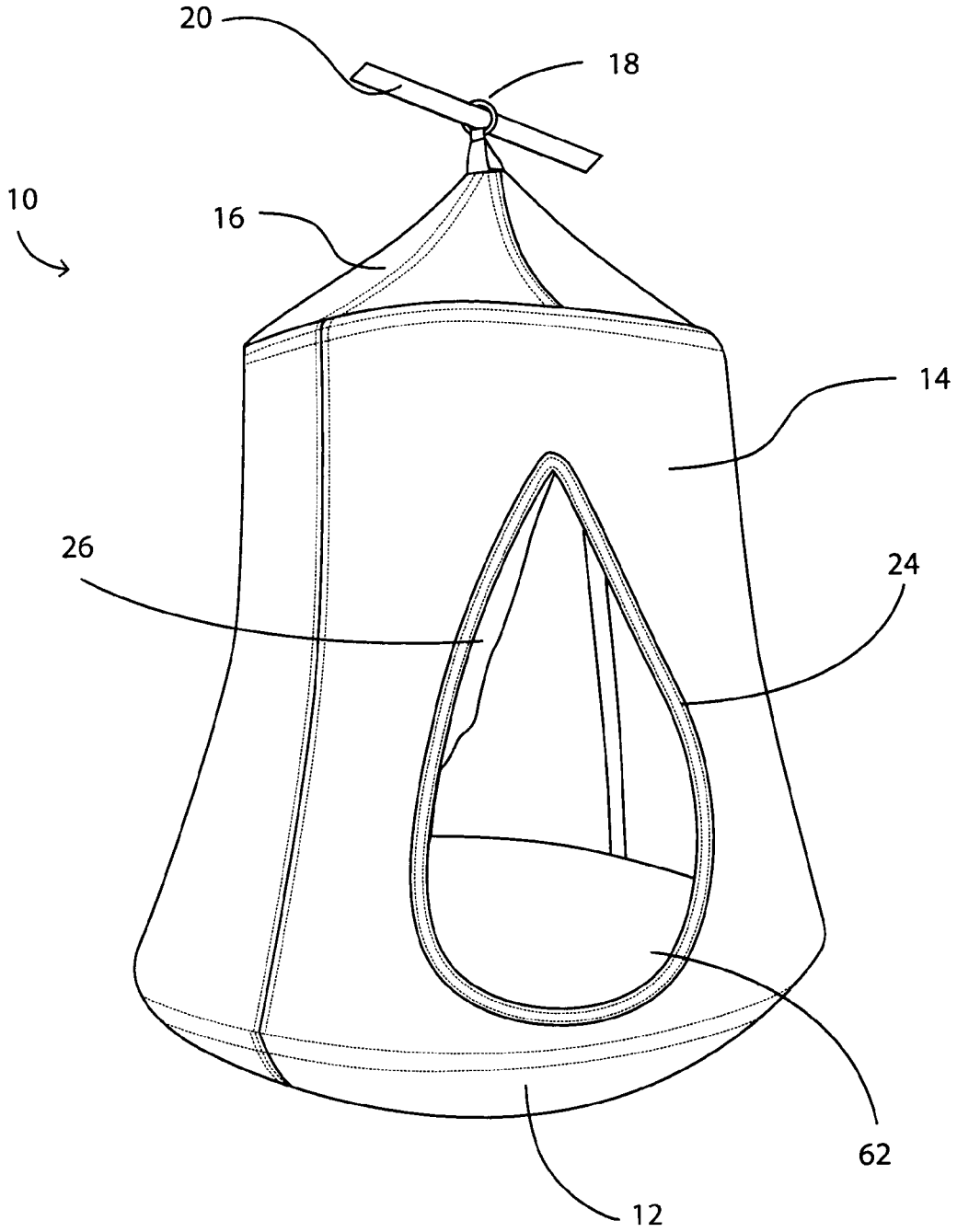
FIG. 7 is a perspective side view of the suspended play structure of FIG. 1.

FIG. 7 also shows the suspended play structure 10 suspended from a hanging support 20 by hanging ring 18. The play structure 10 includes roof 16, sidewall 14, and floor 12. The floor 12 can be observed more readily within the structure 10 when the door flap 26 that normally covers the doorway 24 is held in an open position. The top layer 62 of the floor 12 can be seen in this view. The top layer 62 is designed to support one or more children.

Figure 8:
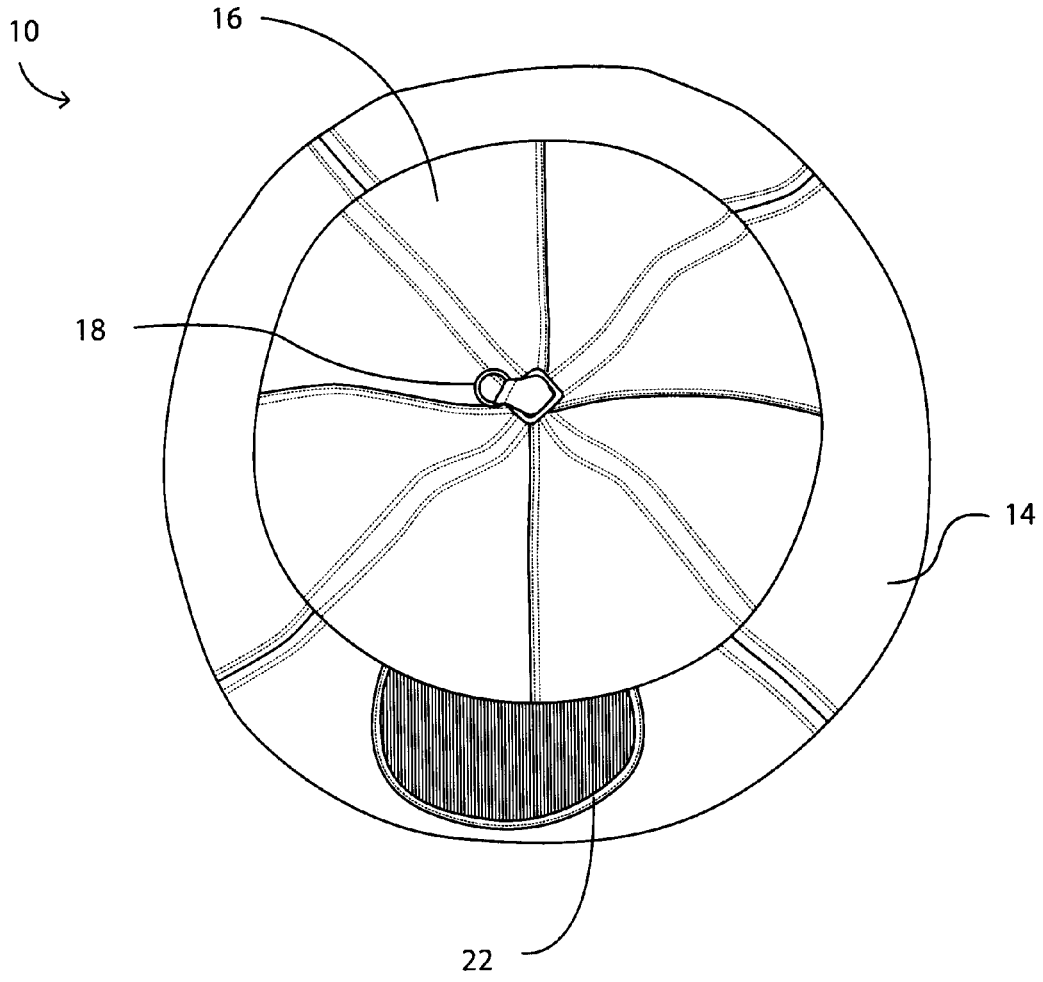
FIG. 8 is a perspective top view of the suspended play structure of FIG. 1.
Figure 9:
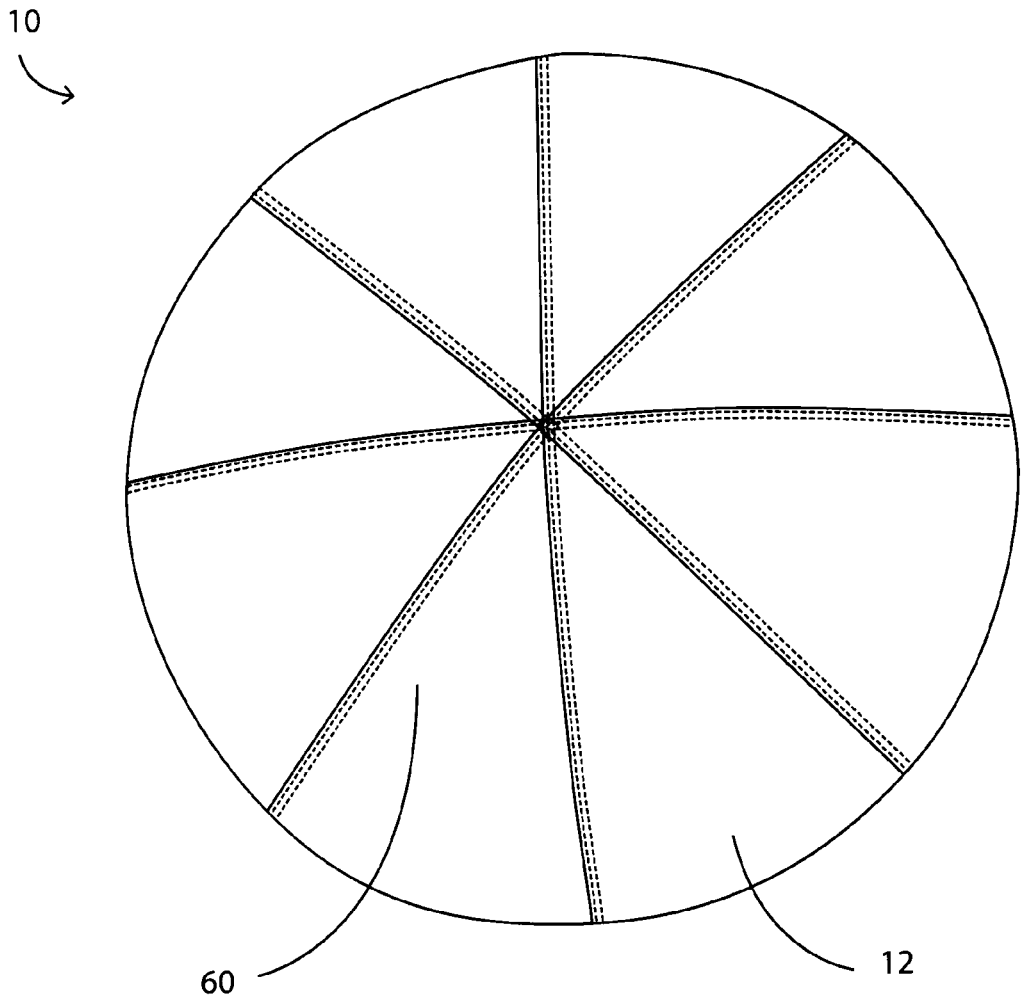
FIG. 9 is a perspective bottom view of the suspended play structure of FIG. 1.

FIG. 8 shows a top view of the suspended play structure 10 to provide details of the hanging ring 18, the roof 16, the sidewall 14, and a window 22. The roof 16 and sidewall 14 are generally made of canvas or similar material. FIG. 9 shows a bottom view of the play structure 10 to provide a detailed view of the floor 12, including the bottom layer 60 of the floor 12. The zipper 28 for opening the internal pocket (not shown) is seen as well.

Figure 10:
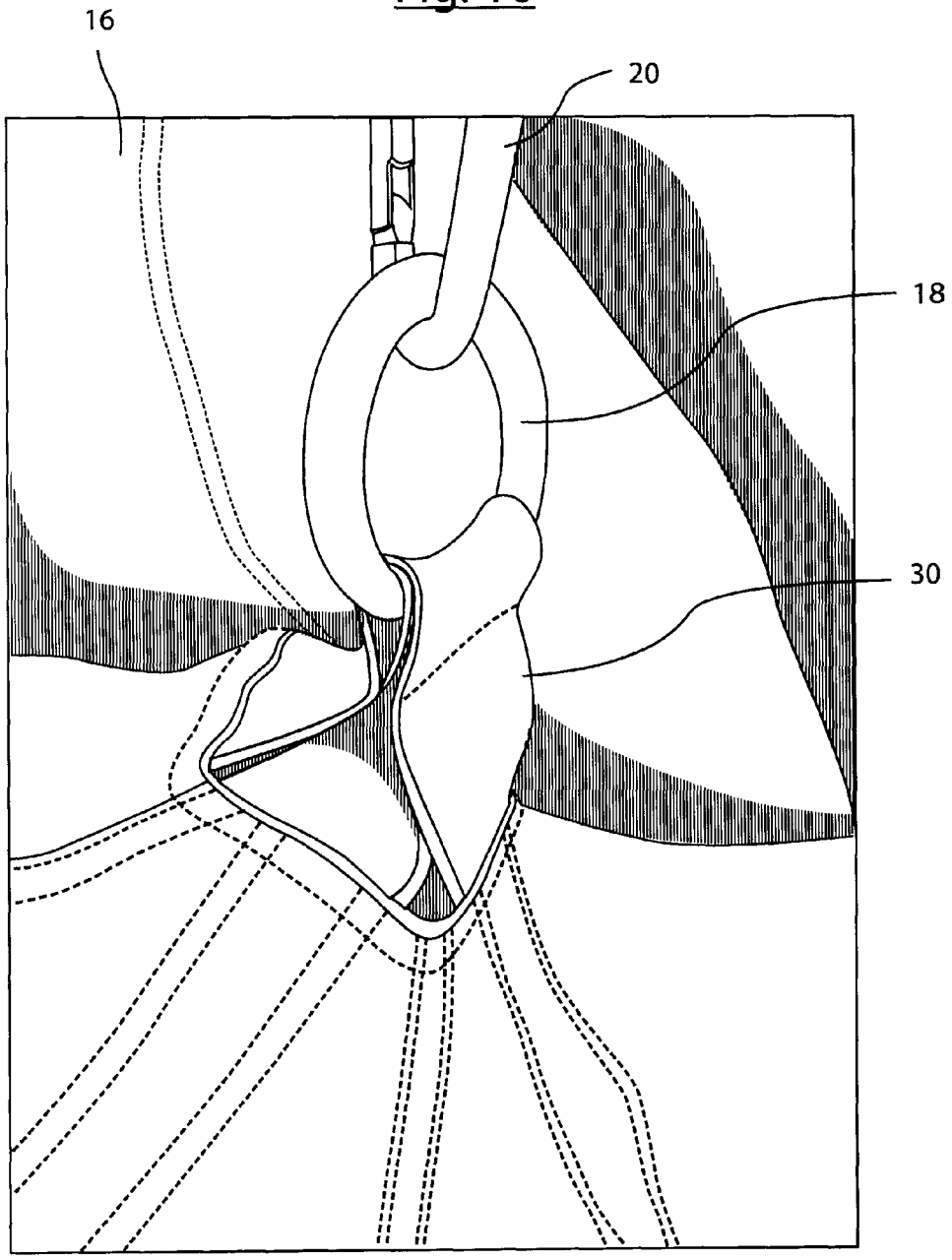
FIG. 10 is a close-up view of the hanging ring of the suspended play structure of FIG. 1.

FIG. 10 shows a view of the roof 16 of the play structure, including the hanging ring 18 attached thereto by support strap 30 that loops around hanging ring 18. The hanging ring 18 is then fastened to a support structure 20 to support the play structure.

Figure 11:
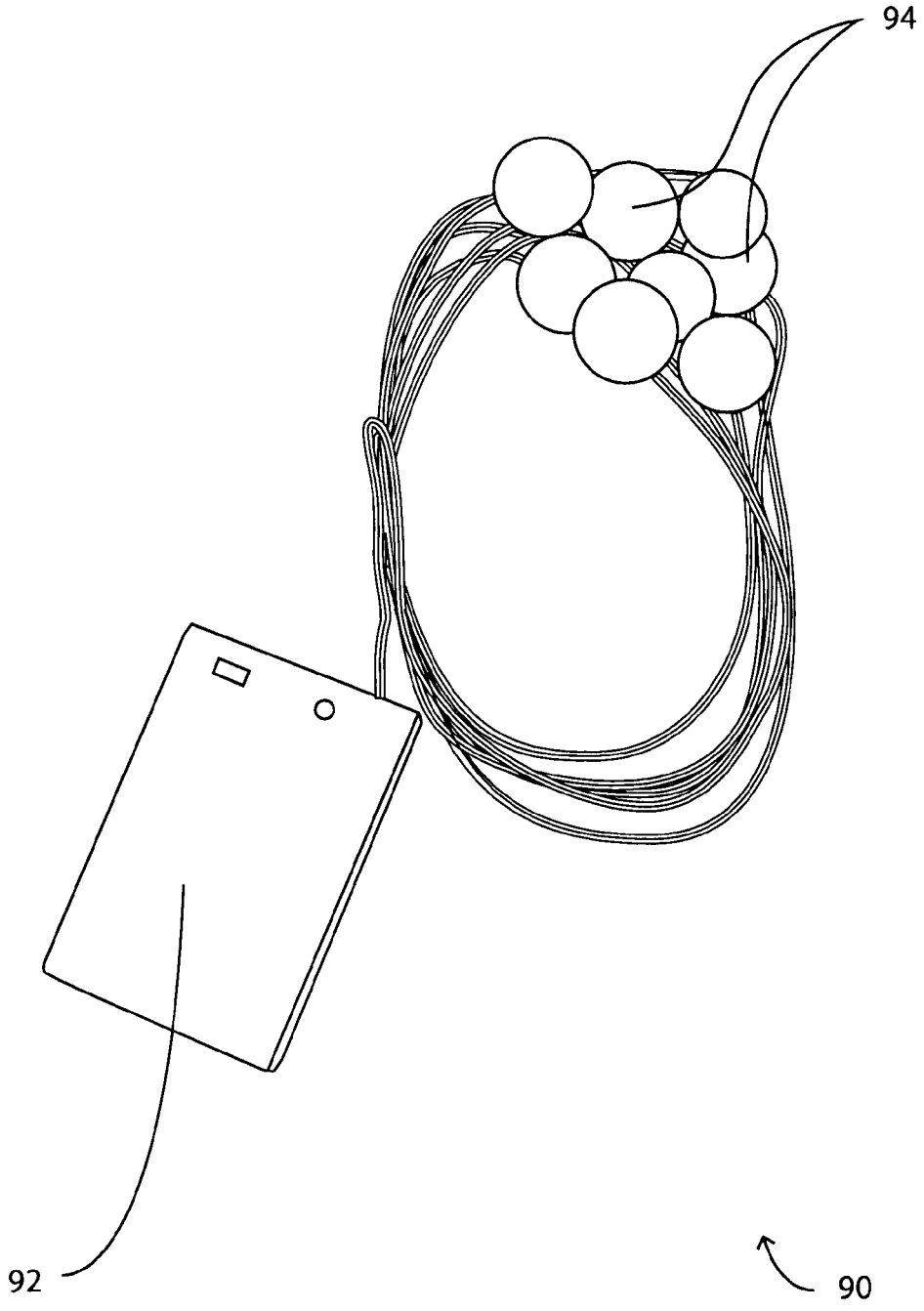
FIG. 11 is a perspective view of string lights.
Figure 12:
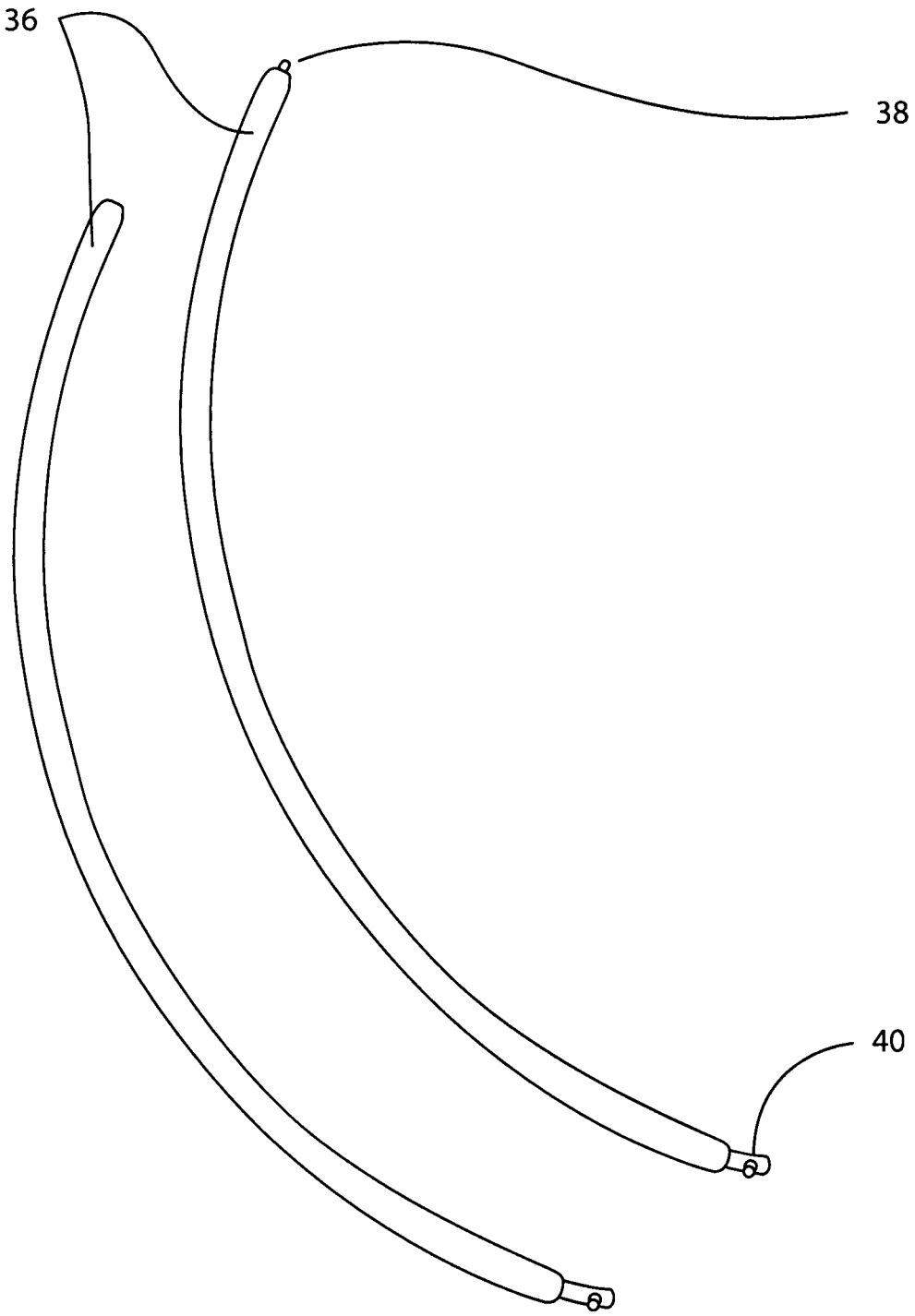
FIG. 12 is a perspective view of two arc-shaped pieces that come together to form the internal support rings.
Figure 13:
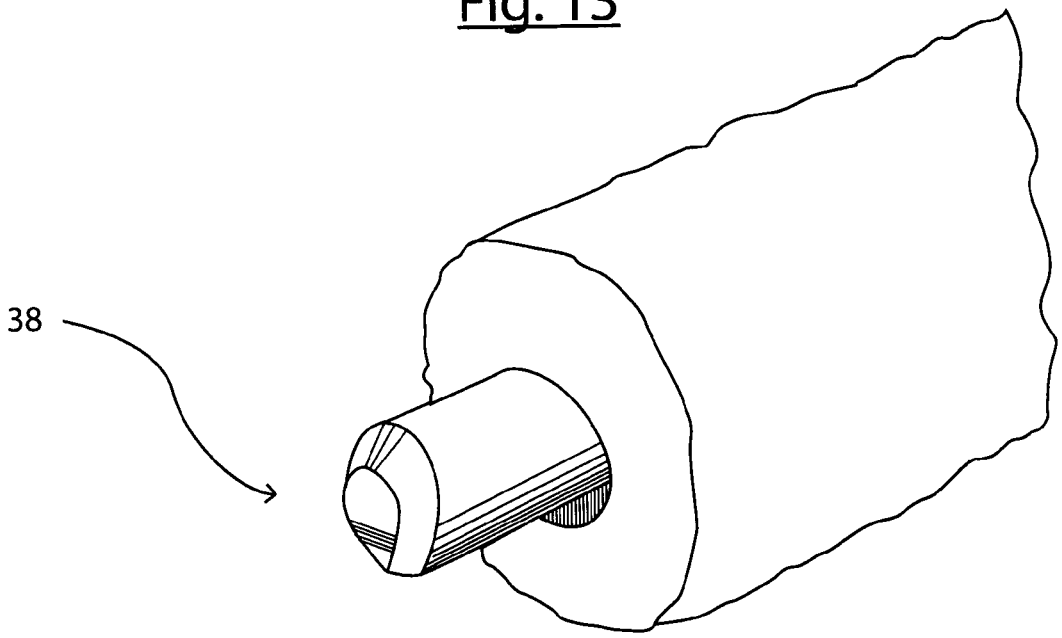
FIG. 13 is a perspective view of a plain first end of an arc-shaped piece.
Figure 14:
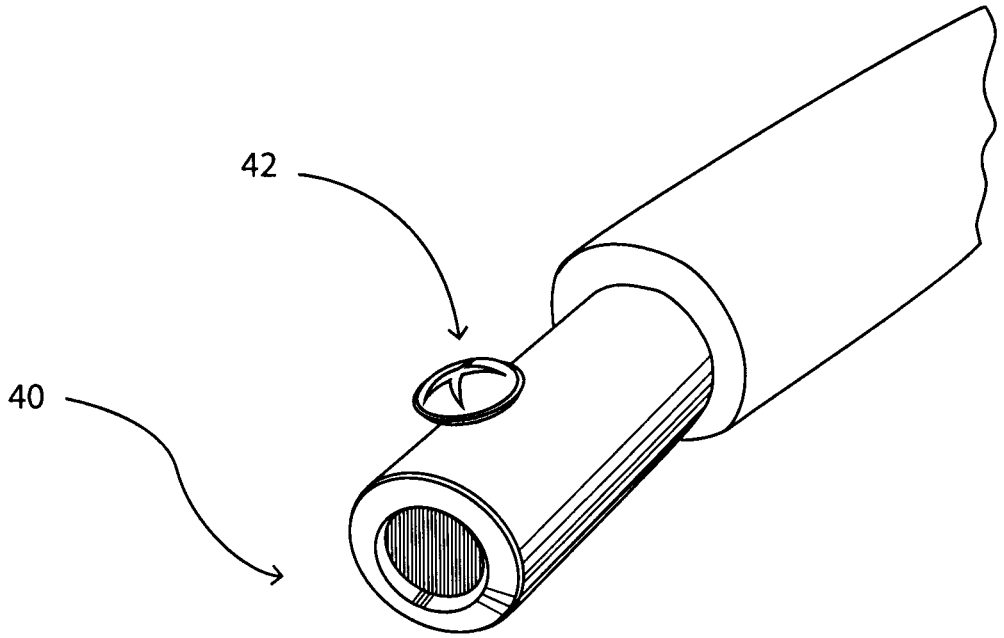
FIG. 14 is a perspective view of a tubular receptacle of an arc-shaped piece.
Figure 15:
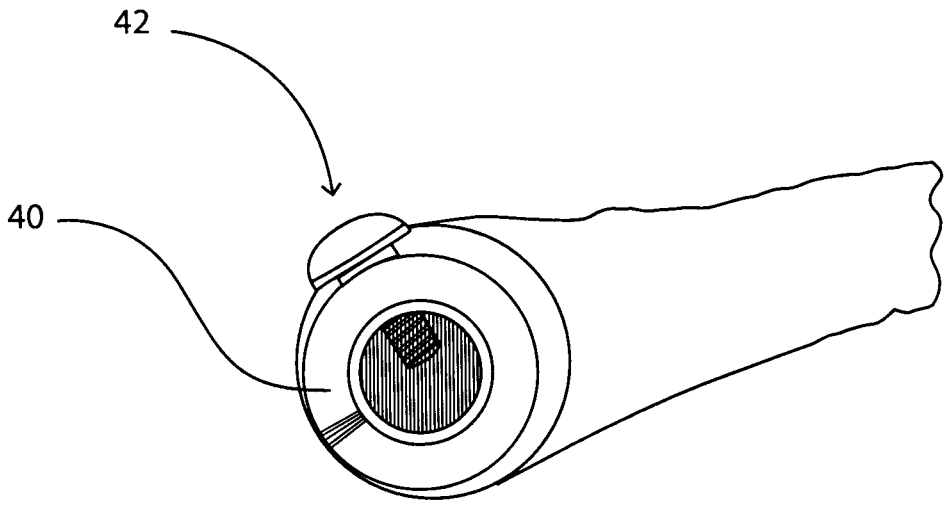
FIG. 15 is a perspective view of a tubular receptacle of an arc-shaped piece.

FIG. 11 shows a string of lights 90 that can be used with the play structure of the present invention. The string lights 90 may include a battery power pack 92, an on/off switch, and a set of LED lights 94.

Figure 16:
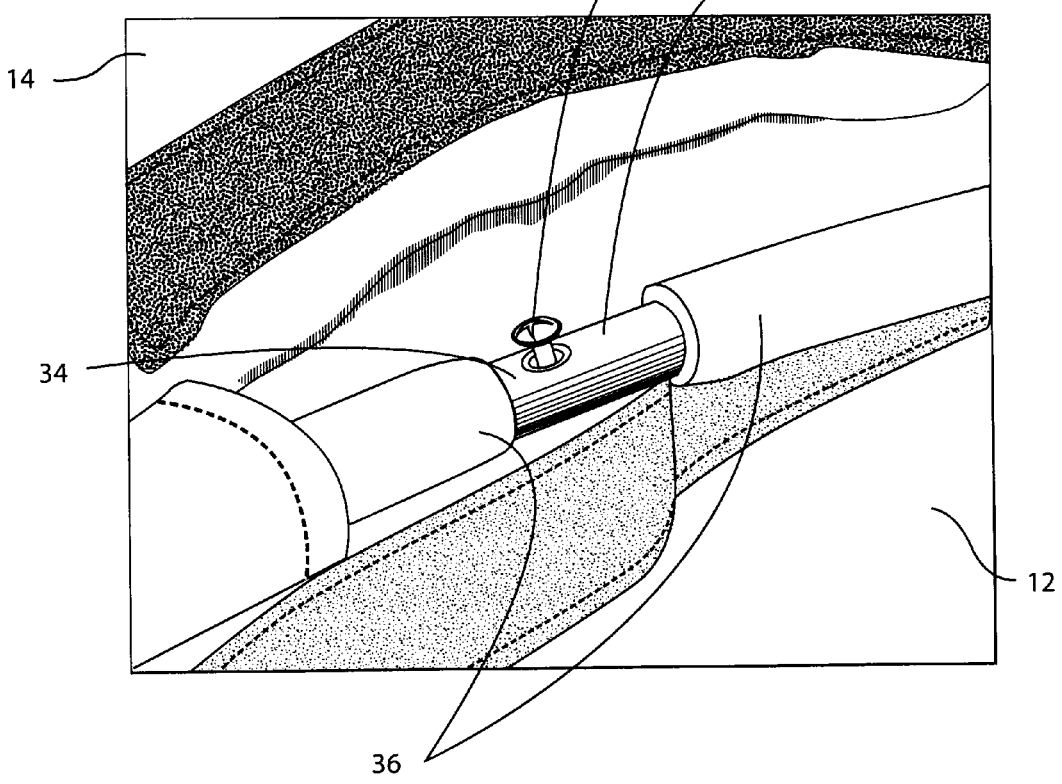
FIG. 16 is a perspective view of the bottom ring from inside the suspended play structure of FIG. 1.

FIGS. 12-16 show the arc-shaped pieces 36 that can be used to form the rings used in the present invention. For example, one of the rings can be made of four separable arc-shaped pieces 36 that attach together end-to-end. Each separable arc-shaped piece has a plain first end 38 comprising a male attachment end and a second end with a tubular receptacle 40 comprising a female attachment end sized to fit around the plain first end 38 of an adjacent arc-shaped piece 36. The tubular receptacle includes a set screw 42 configured to provide additional friction to the plain first end of the adjacent arc-shaped piece 36 when the bottom ring 34 is fully assembled. FIG. 16 shows the bottom ring 34 deployed within sidewall 14 through an openable sleeve.

Figure 17:
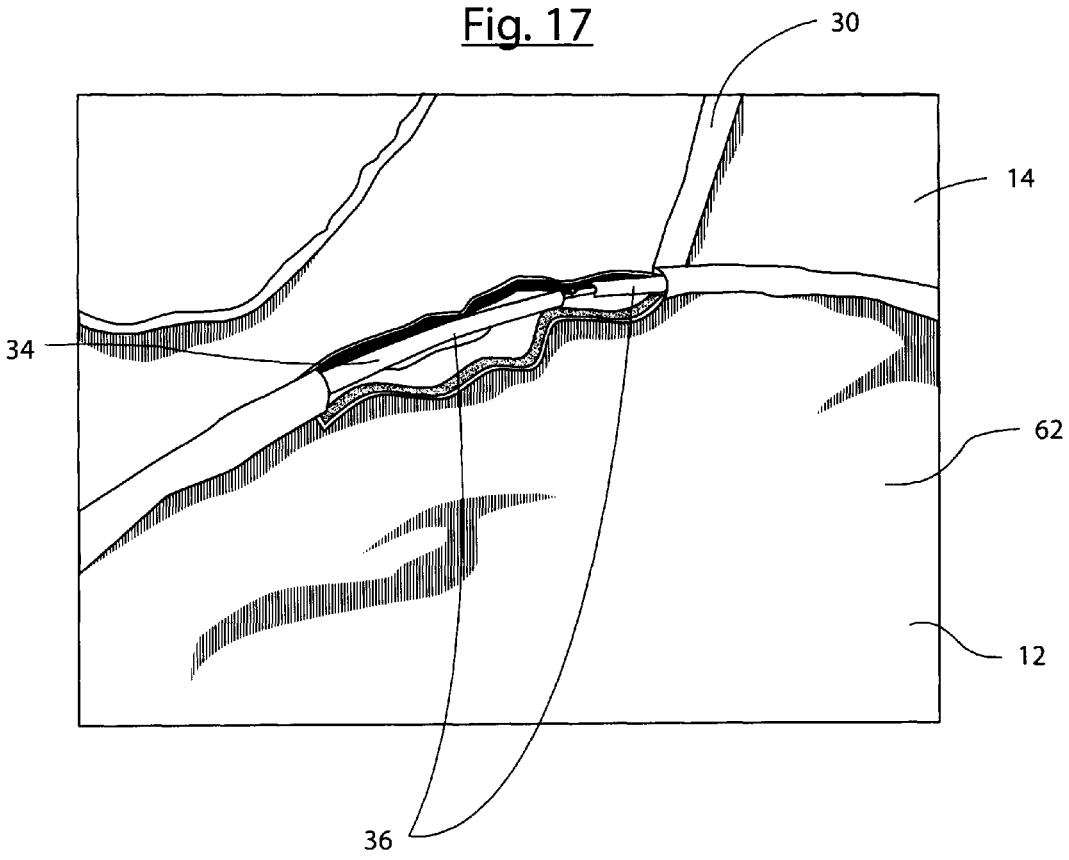
FIG. 17 is a perspective view of the bottom ring from inside the suspended play structure of FIG. 1.

FIG. 17 shows another view of the bottom ring 34 from inside the play structure. The arc-shaped pieces 36 are seen between the openable sleeves fit together to form the ring 34. The top layer 62 of the floor 12 is seen with the openable sleeves around the edge to hold the bottom ring 34. A support strap 30 is shown running up the side of the play structure within the wall.

Figure 18:
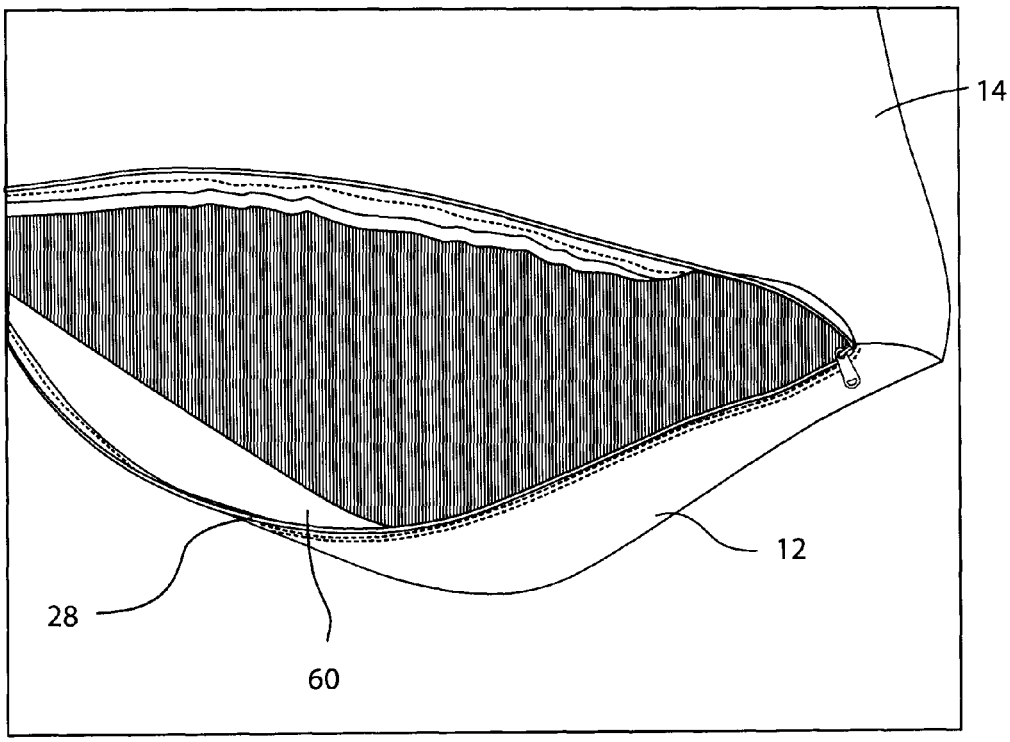
FIG. 18 is a perspective view of the internal pocket and zipper closure of the suspended play structure of FIG. 1.
Figure 19:
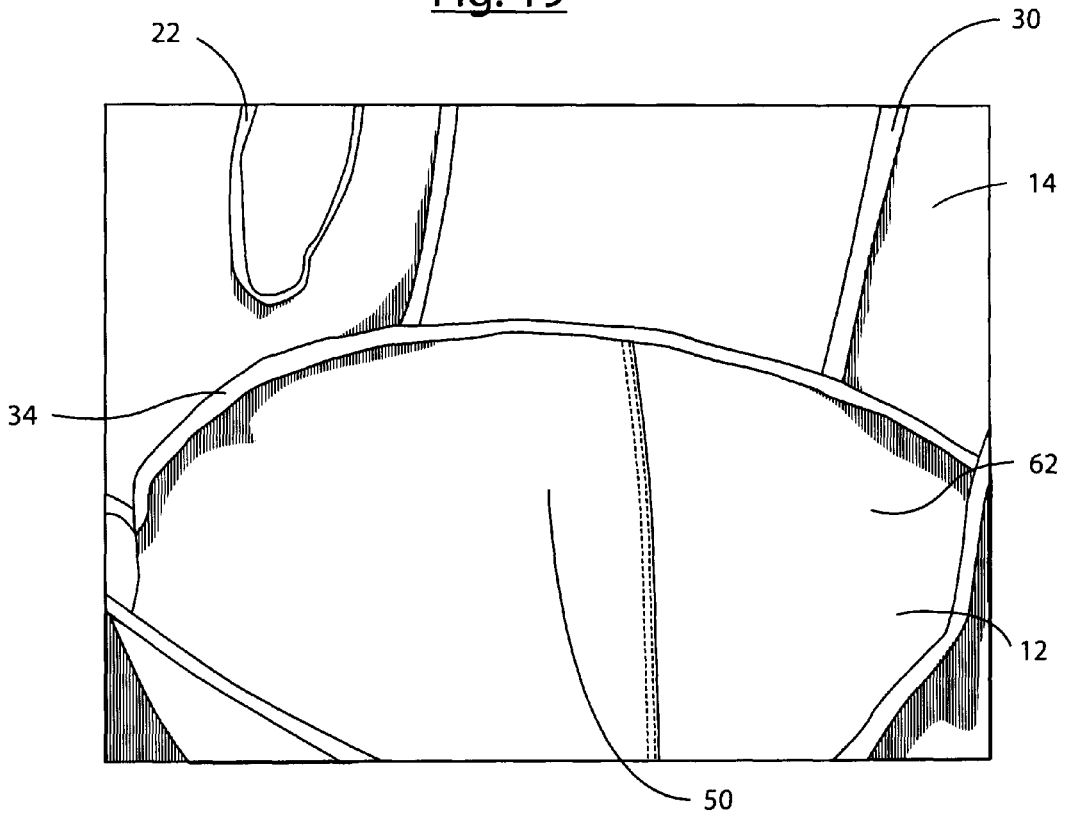
FIG. 19 is a perspective view of the top layer of the floor from inside the suspended play structure of FIG. 1.

FIG. 18 shows the internal pocket between the top layer and the bottom layer 60 of the floor 12. The internal cushion can be supported within this pocket. The top layer 62 of the floor 12 is shown in FIG. 19, where the internal cushion 50 would be located under the top layer 62. Support straps 30 are also shown within the walls 14 of the structure. A window 22 is shown in a portion of the wall. The support ring 34 and internal cushion 50 are located within or under other layers and cannot actually be seen in this view.

Figure 20:
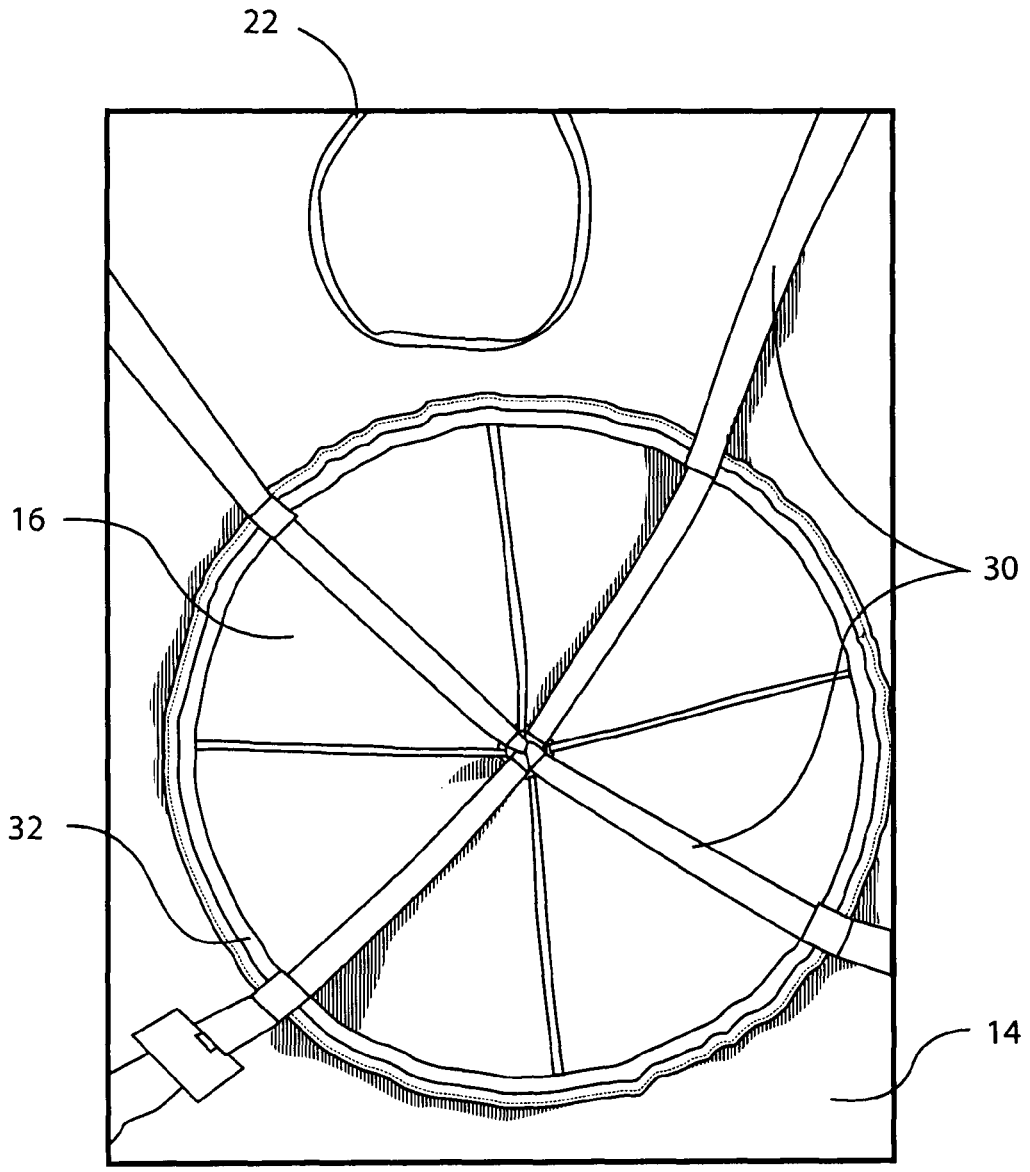
FIG. 20 is a perspective view of the roof from inside the suspended play structure of FIG. 1.
Figure 21:
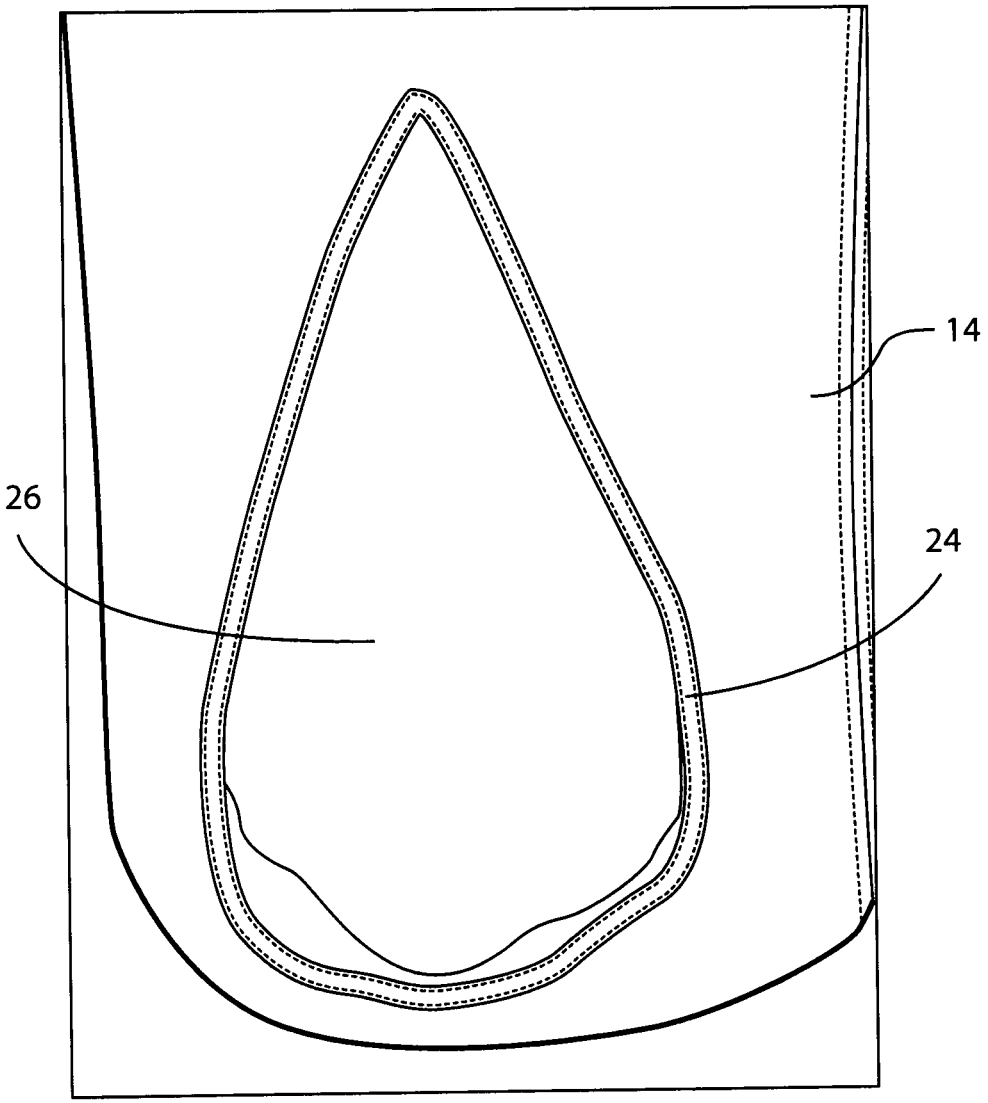
FIG. 21 is a perspective view of the doorway and door flap of the suspended play structure of FIG. 1.
Figure 22:
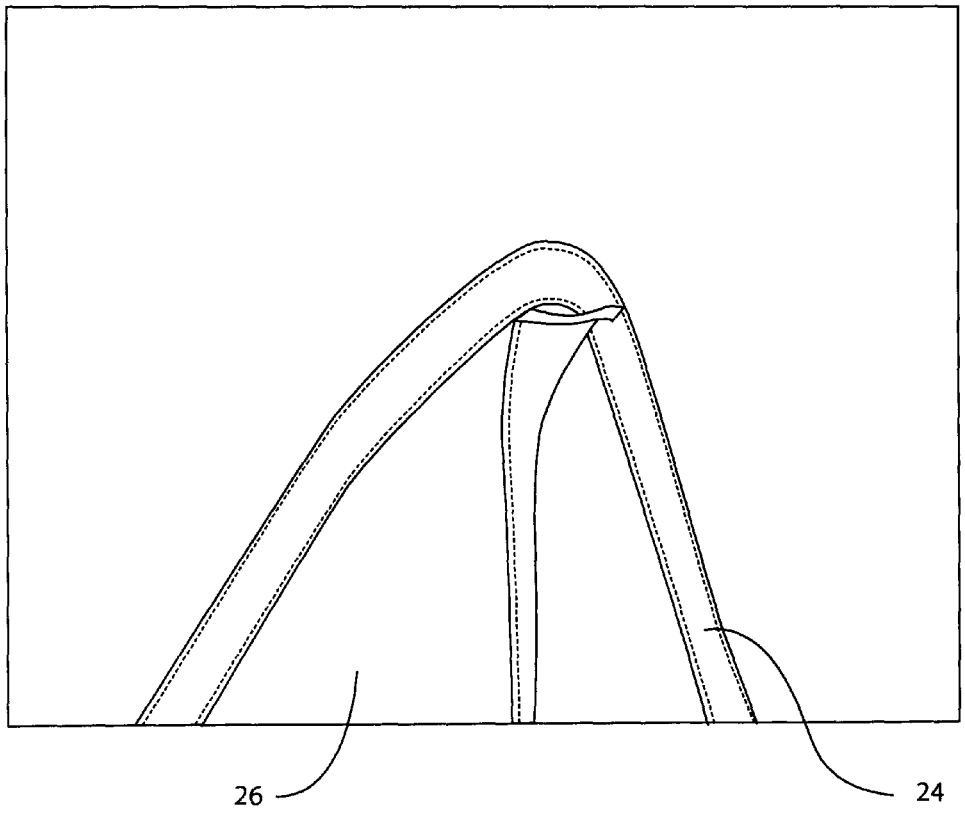
FIG. 22 is a perspective view of a portion of the doorway and door flap of the suspended play structure of FIG. 1.
Figure 23:
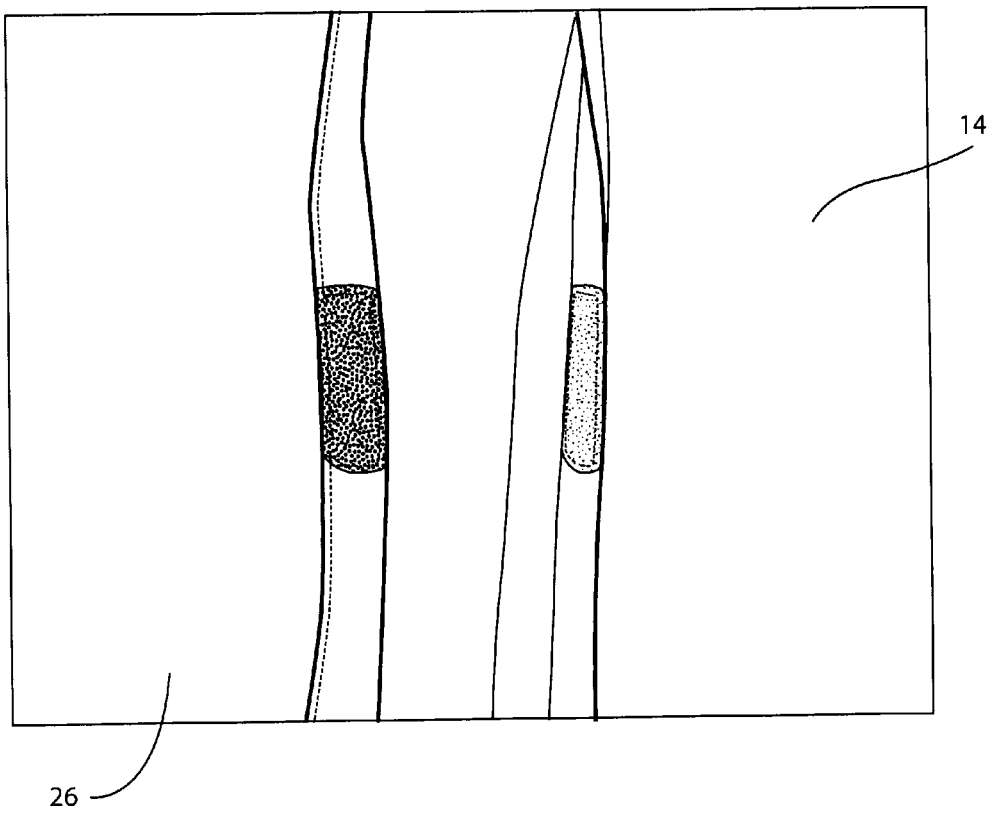
FIG. 23 is a perspective view of a portion of the doorway and door flap of the suspended play structure of FIG. 1.

FIG. 20 shows a view of the roof 16 of the play structure from inside. Four support straps 30 are shown to support the play structure. They run from the top of the structure down to the bottom ring. The top ring 32 is shown within a sleeve between the roof 16 and the walls that include a window 22.

Figure 24:
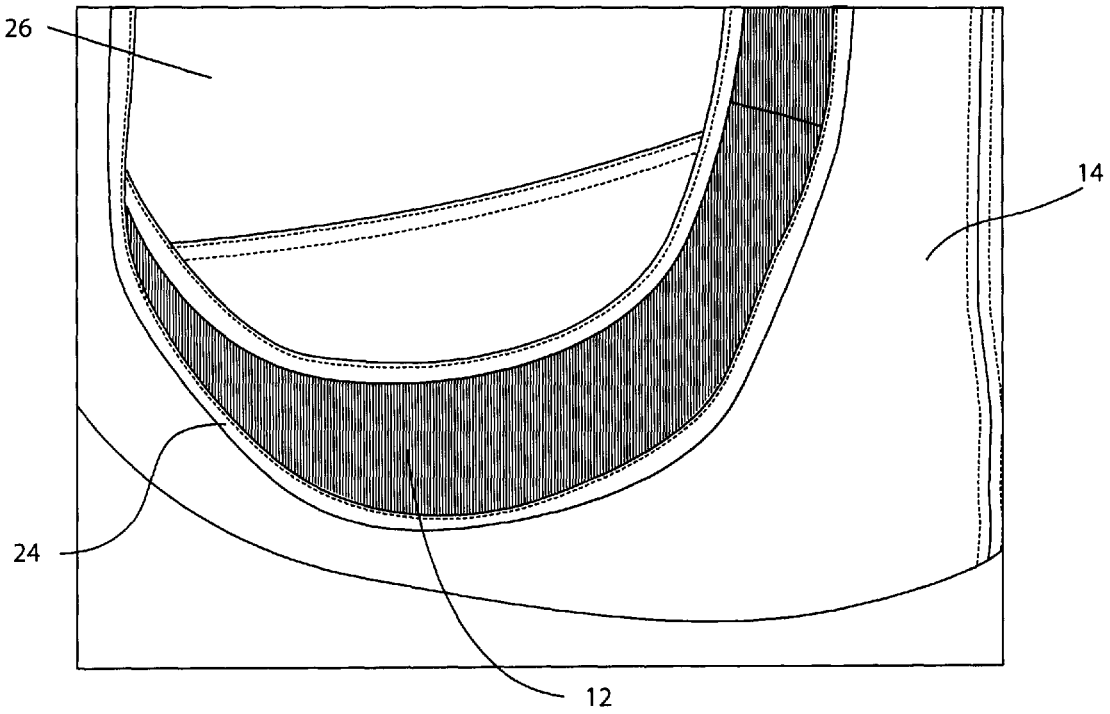
FIG. 24 is a perspective view of the doorway and door flap of the suspended play structure of FIG. 1.
Figure 25:
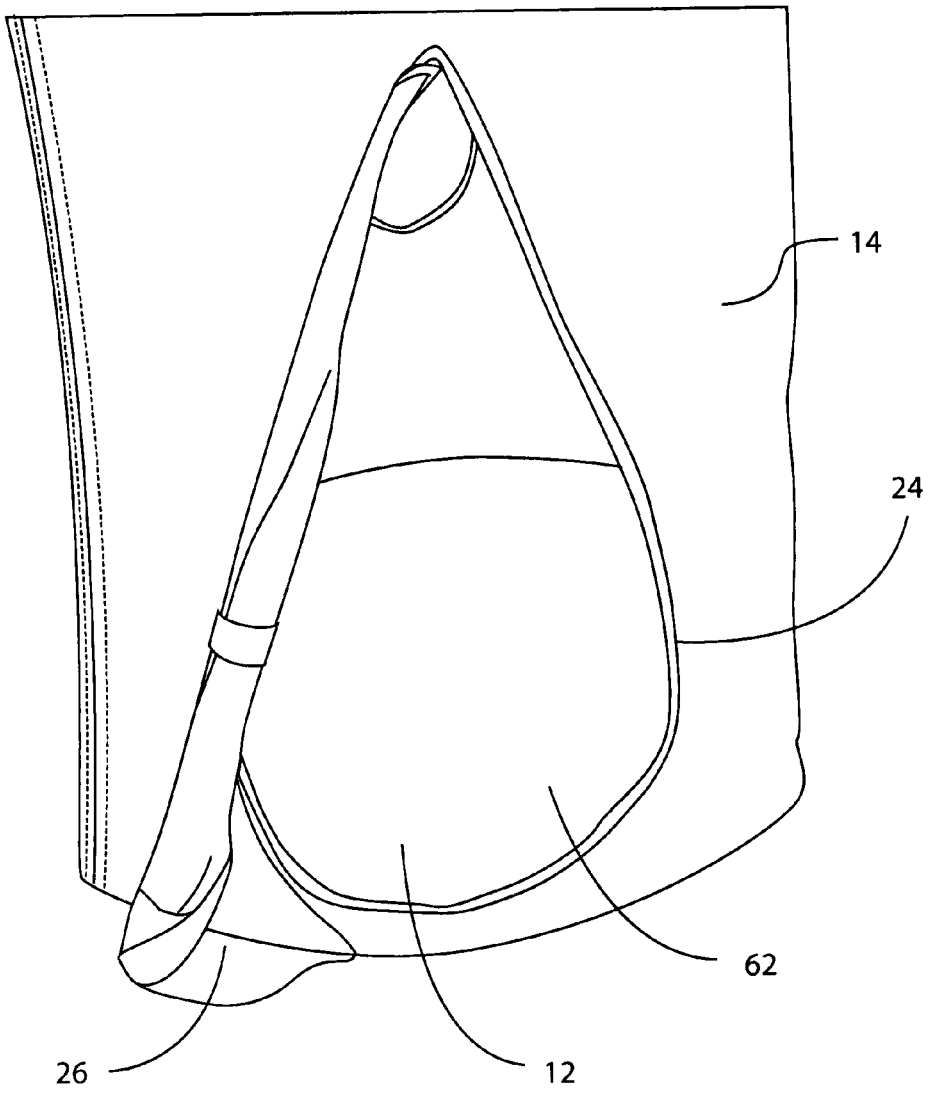
FIG. 25 is a perspective view of the doorway and door flap of the suspended play structure of FIG. 1.
Figure 26:
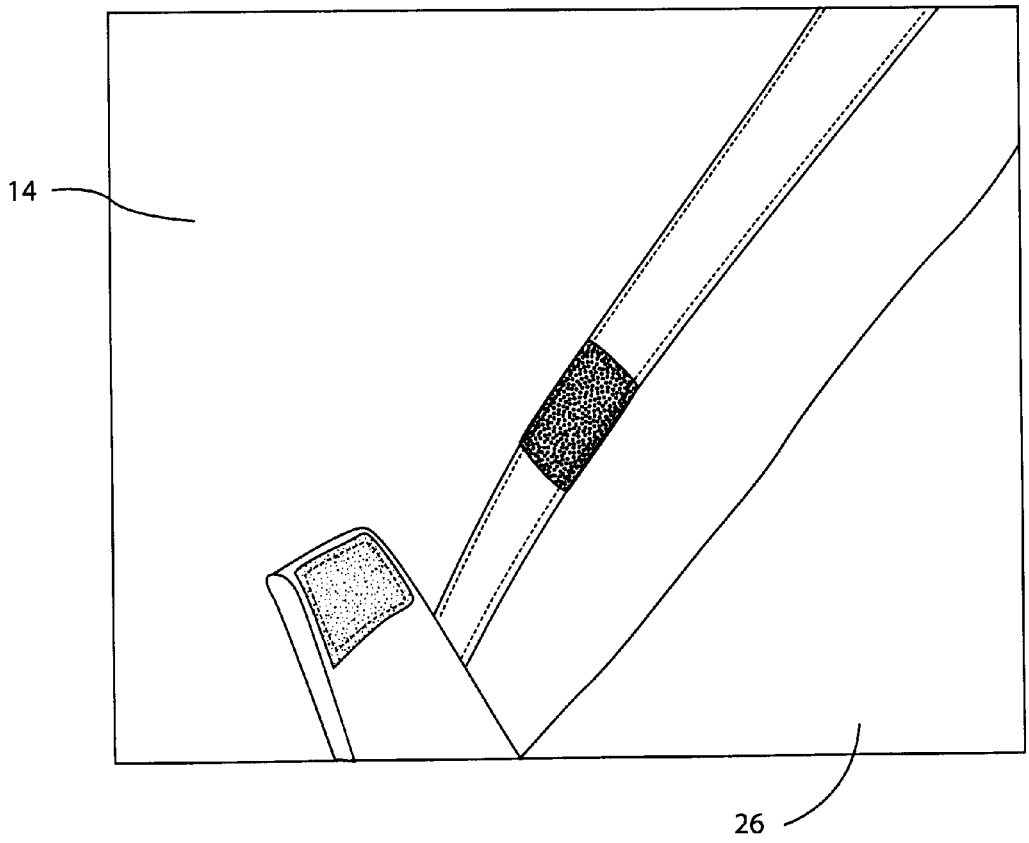
FIG. 26 is a perspective view of the door flap of the suspended play structure of FIG. 1.
Figure 27:
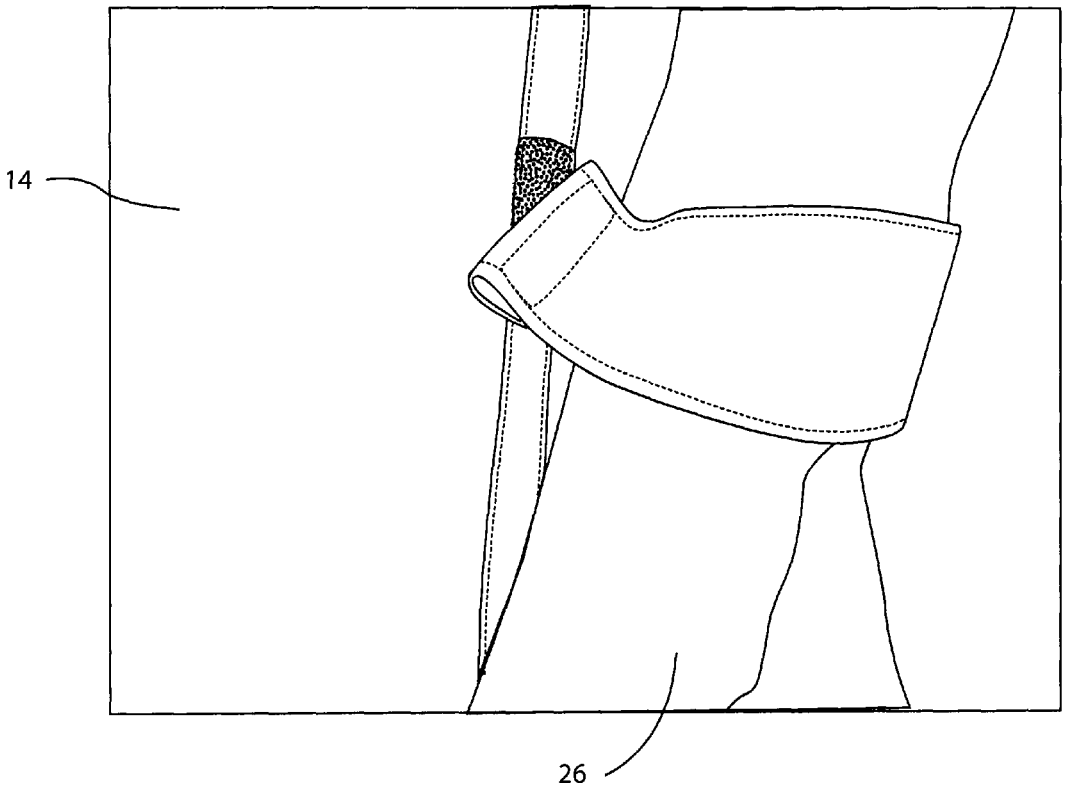
FIG. 27 is a perspective view of the door flap of the suspended play structure of FIG. 1.
Figure 28:
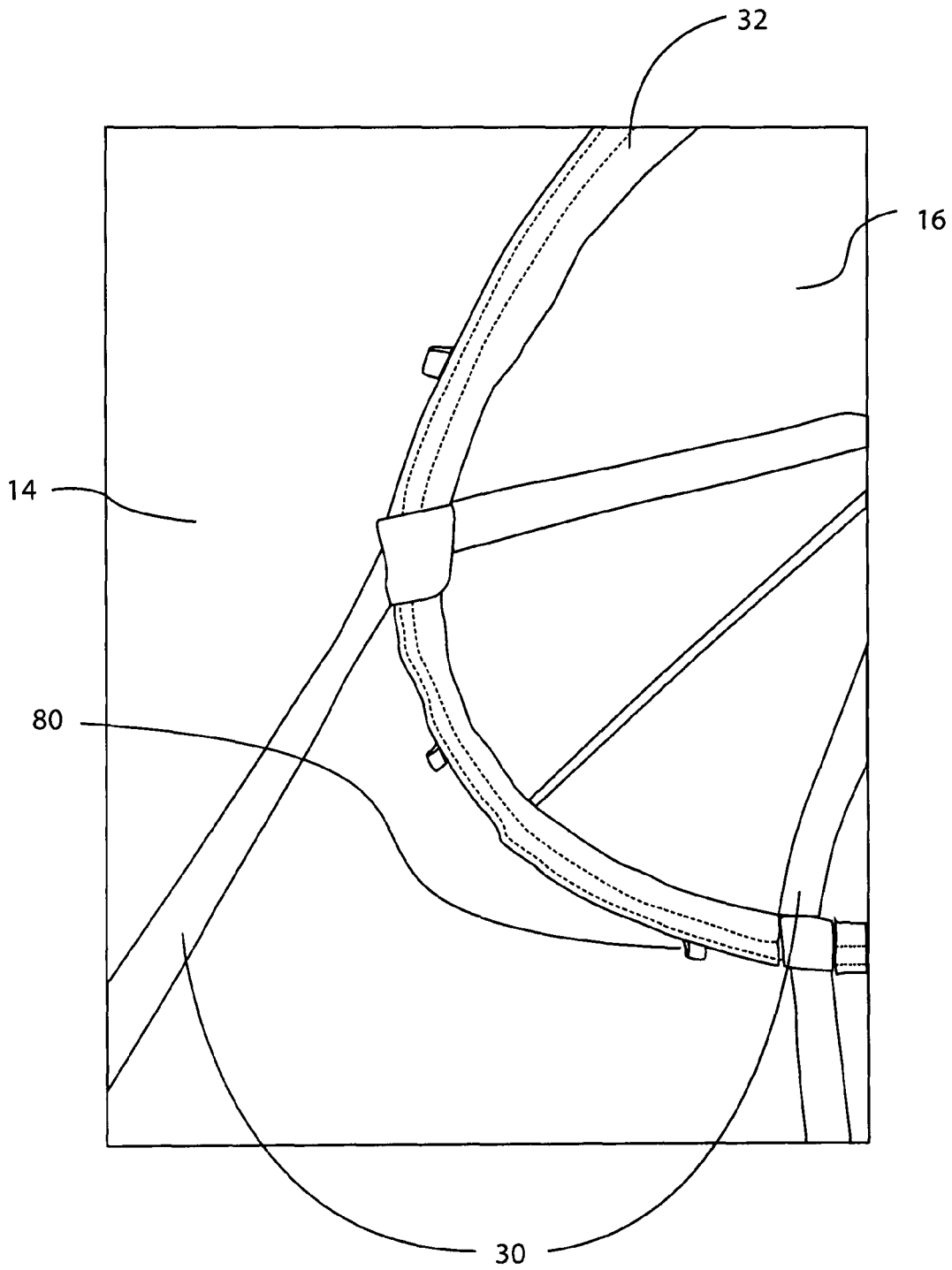
FIG. 28 is a perspective view of the roof from inside the suspended play structure of FIG. 1.
Figure 29:
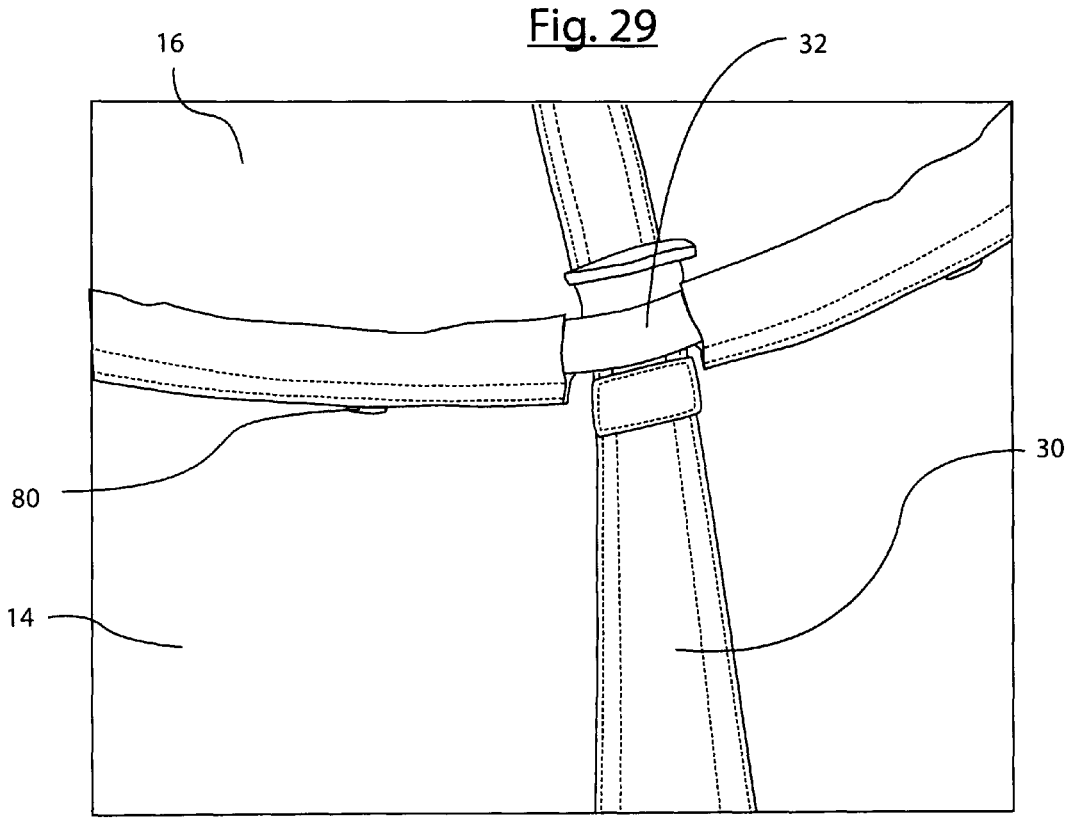
FIG. 29 is a perspective view of the top ring from inside the suspended play structure of FIG. 1.
Figure 30:
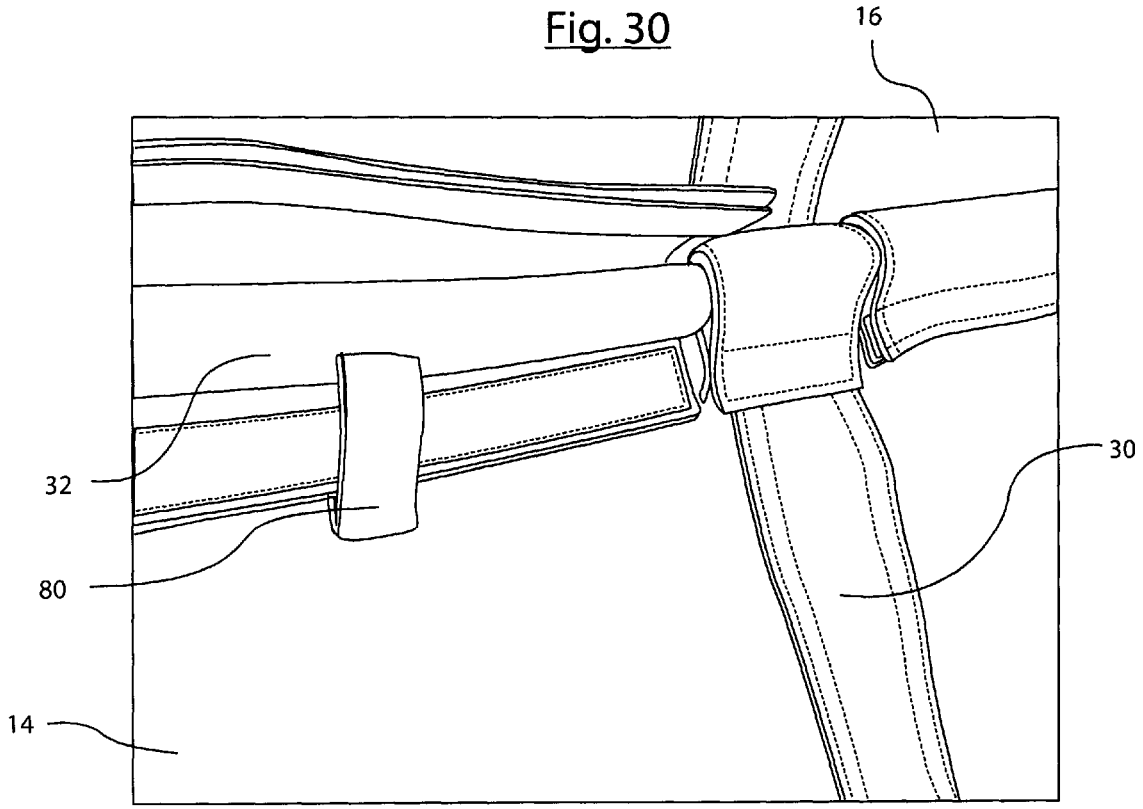
FIG. 30 is a perspective view of the top ring from inside the suspended play structure of FIG. 1.
Figure 31:
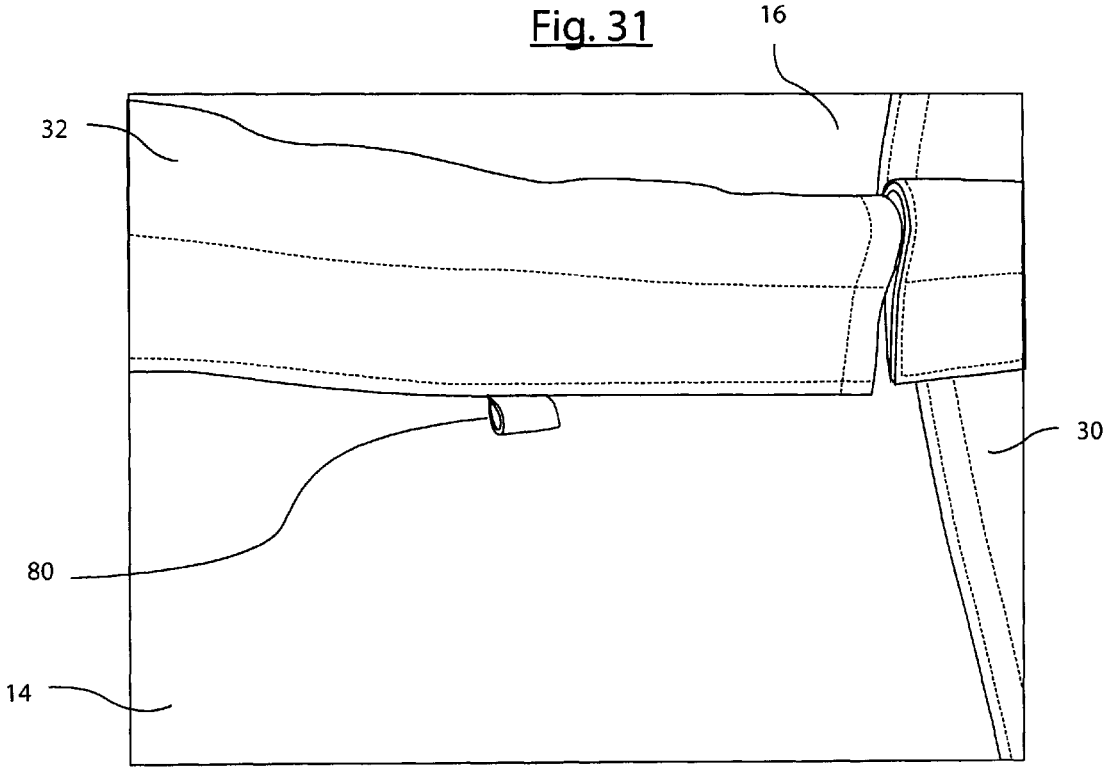
FIG. 31 is a perspective view of the top ring from inside the suspended play structure of FIG. 1.

FIGS. 21-27 show a doorway 24 that is covered by a flap 26. In this way, the doorway 24 can be opened or closed for ingress or egress to the inside of the play structure. Hook-and-loop fasteners (shown in FIGS. 23 and 26-27) or other structures can be used to secure the flap 26 in the open or closed position, as desired. FIG. 24 shows the flap 26 partially opened to provide a view of the floor 12 within the play structure, while FIG. 25 shows the flap 26 secured in the open position to show the top layer 62 of the floor 12 within the play structure.

Figure 36:
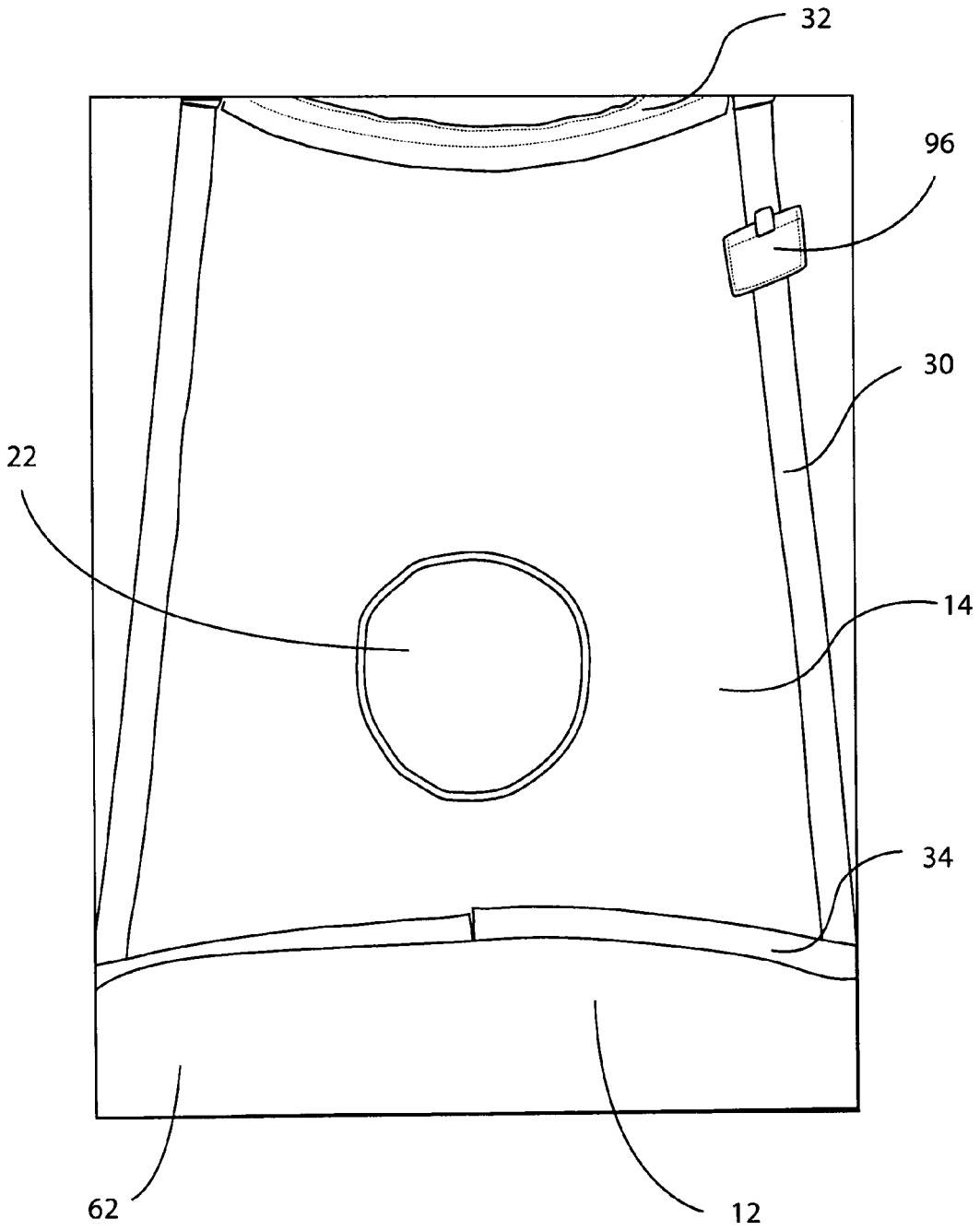
FIG. 36 is a perspective view of a window from inside the suspended play structure of FIG. 1.

FIGS. 28-31 and 34 show the inside of the play structure. Inside the suspended play structure 10, attachment points 80 may be located on the sidewall 14 or roof 16 and may be located at the intersection of the sidewall 14 and the roof 16. The attachment points 80 may be made from a loop of hook-and-loop fastener material that interacts with hook-and-loop fastener material sewn or otherwise attached to the sidewall 14 and/or roof 16. In this fashion, the attachment points 80 may be used to removably secure accessories. The top ring 32 is shown supporting the roof 16 and the sidewall 14. The top ring 32 is removably secured inside sleeves using hook-and-loop fasteners. In the implementation shown in FIGS. 30-31, the attachment points 80 are attached to the sleeves. An accessory pocket 96, as described above, is shown in FIG. 36.

Figure 32:
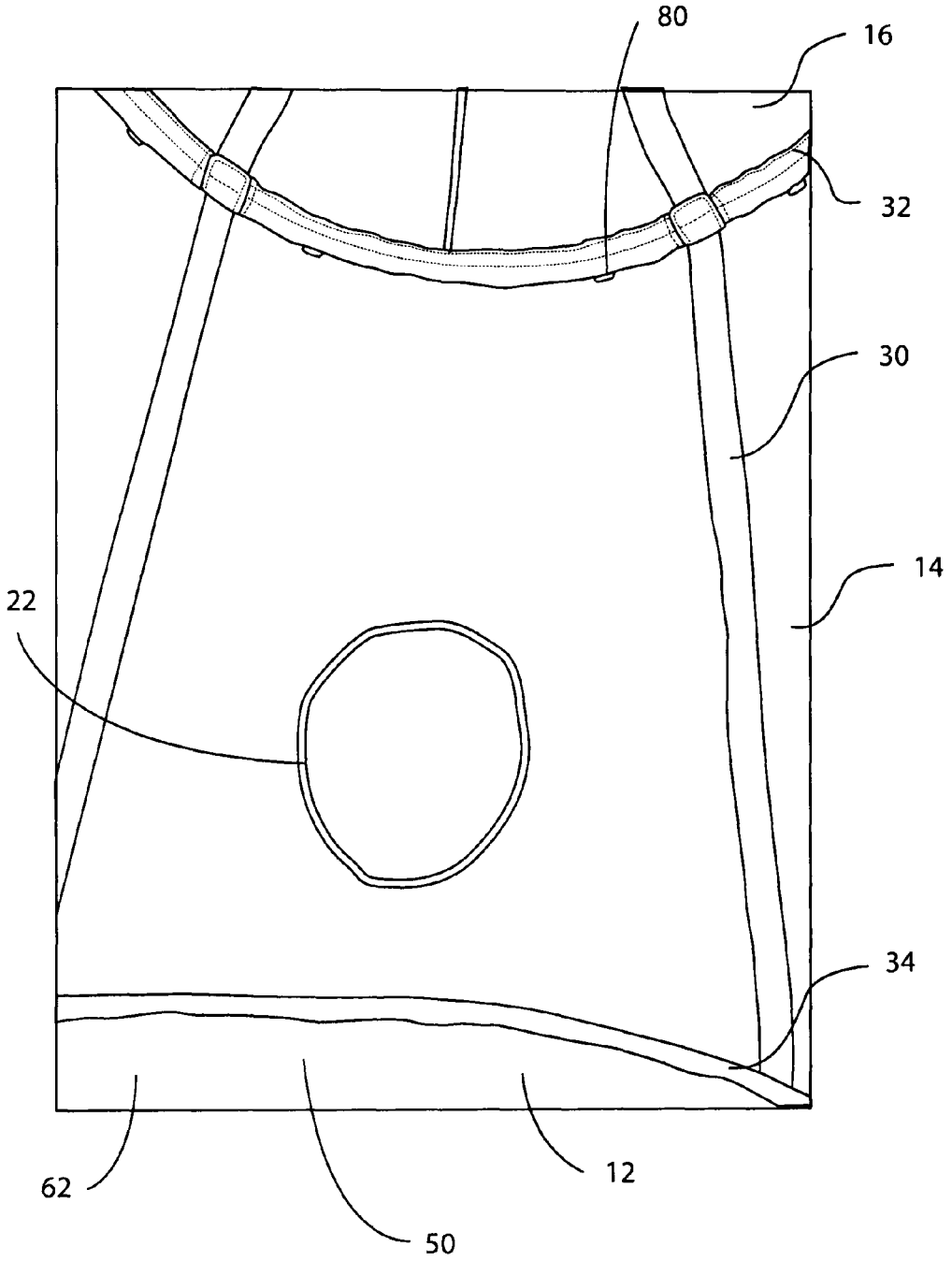
FIG. 32 is a perspective view of a window from inside the suspended play structure of FIG. 1.
Figure 33:
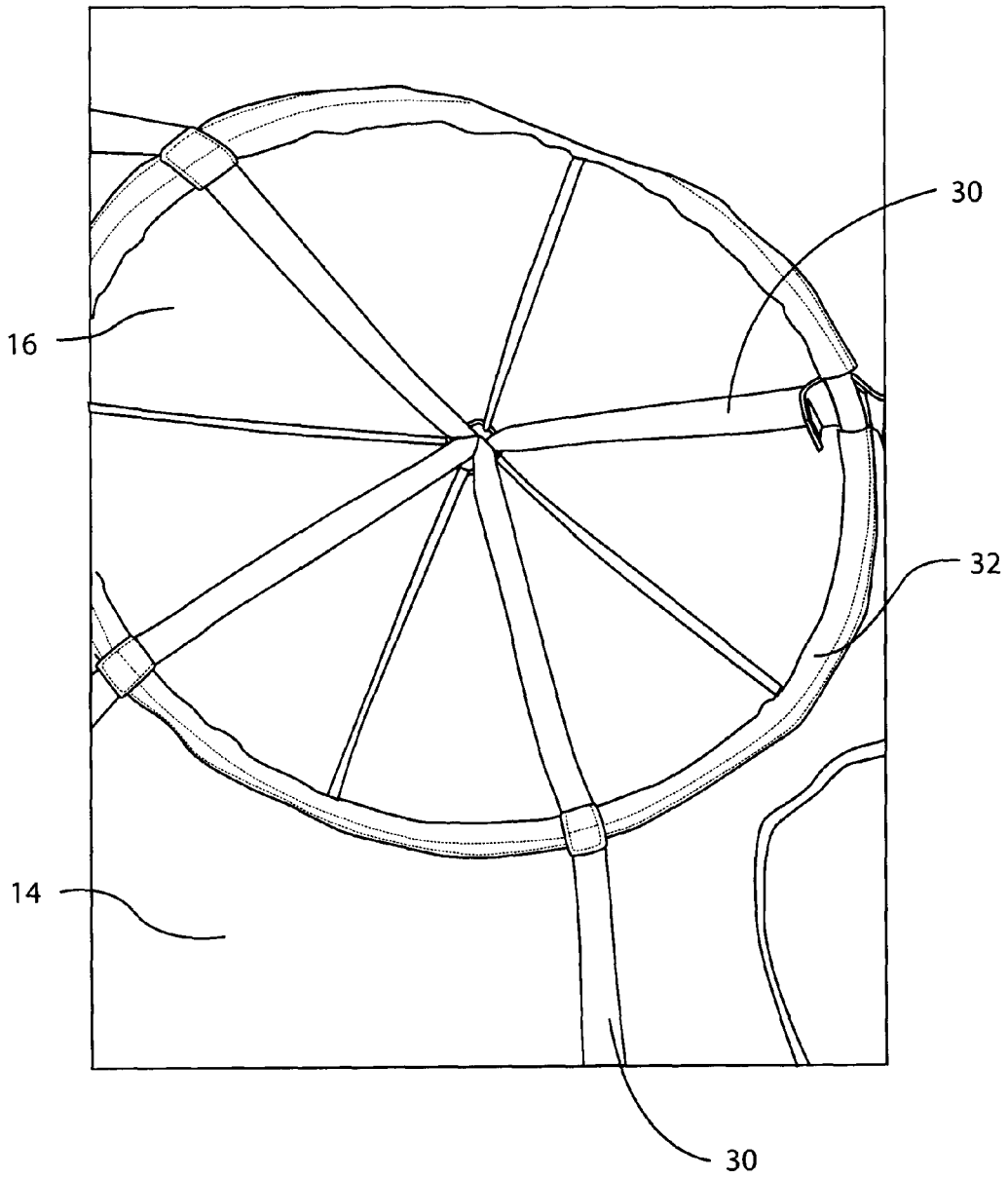
FIG. 33 is a perspective view of the roof from inside the suspended play structure of FIG. 1.
Figure 34:
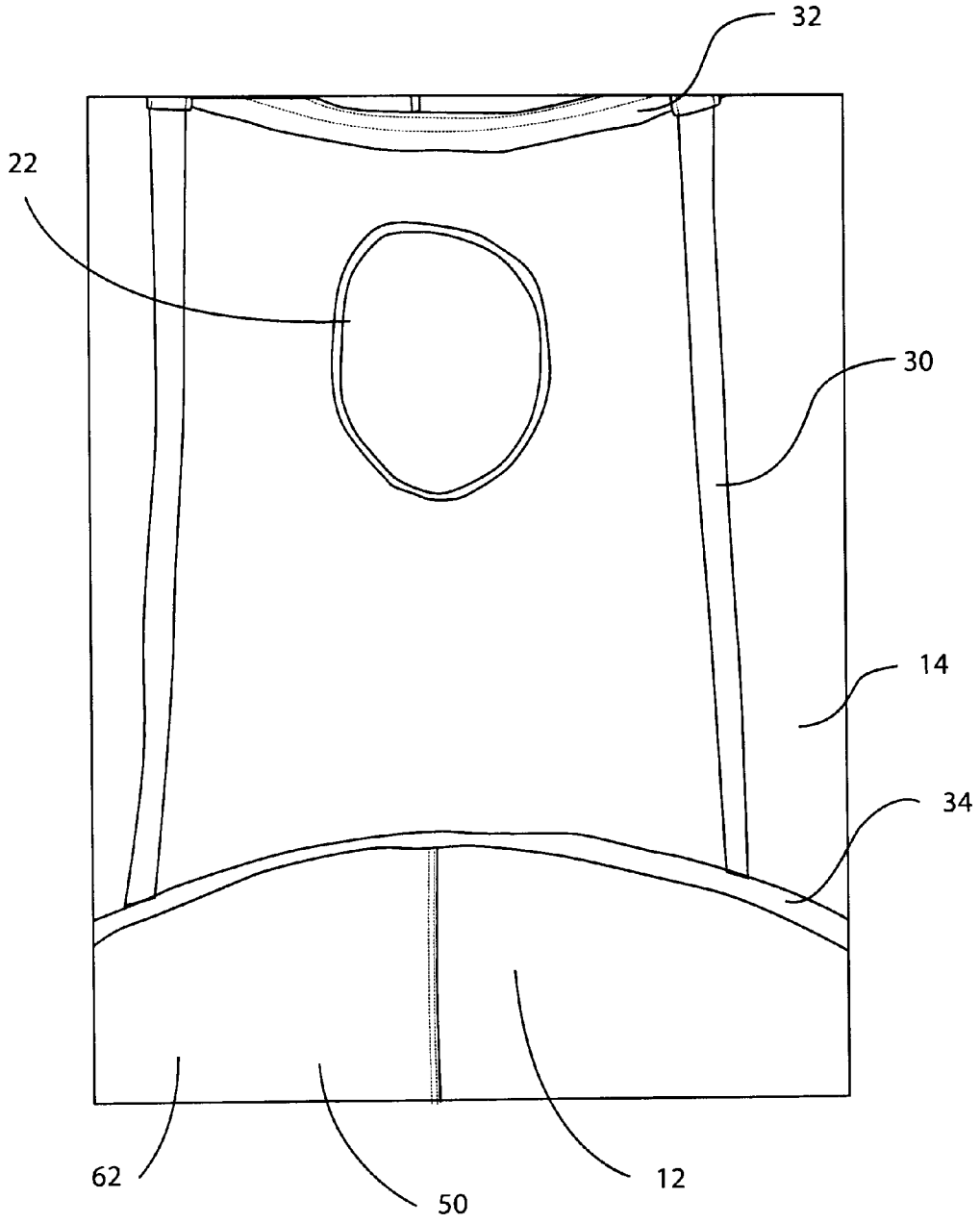
FIG. 34 is a perspective view of a window from inside the suspended play structure of FIG. 1.
Figure 35:
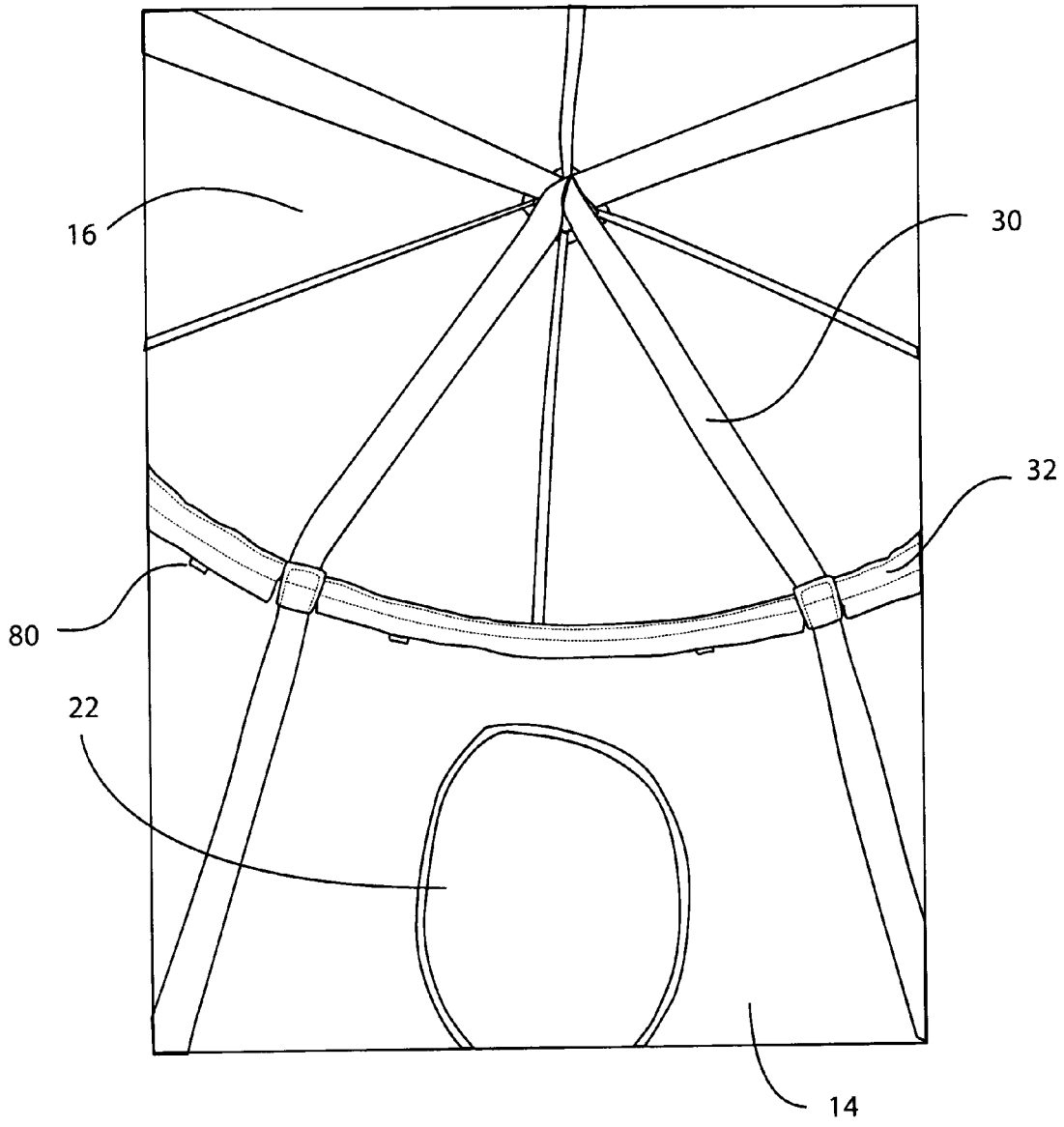
FIG. 35 is a perspective view of a window and the roof from inside the suspended play structure of FIG. 1.

FIGS. 32-33 and 35 show various features of the suspended play structure from the inside. A window 22 is shown in the sidewall 14. The top ring 32 and the bottom ring 34 support the structure. Support straps 30 run from the top of the structure to the bottom ring 34. The internal cushion 50 is located under the top layer 62 of the floor 12. An attachment point 80 for accessories is located near the roof 16.

Figure 37:
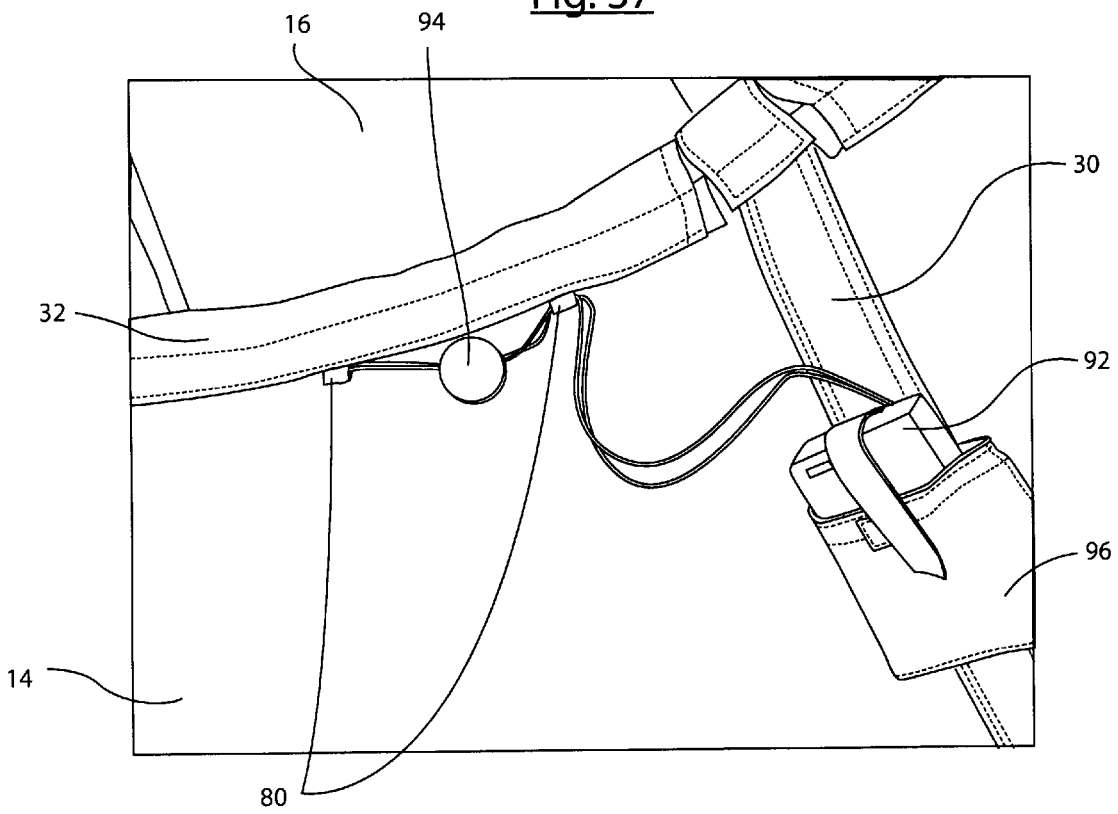
FIG. 37 is a perspective view of the string lights and attachment points from inside the suspended play structure of FIG. 1.

FIG. 37 shows the support structure implemented with internal lighting. A battery power pack 92 is held within accessory pocket 96. A string of LED lights 94 runs along the top ring 32 at the top of the structure between the roof 16 and the sidewall 14. The string is held in place at the attachment points. The string will provide lighting within the support structure so that the structure can be used at night or in dark conditions for activities that require light, such as reading.

While the invention has been described in conjunction with specific exemplary implementations, it is evident to those skilled in the art that many alternatives, modifications, and variations will be apparent in light of the foregoing description. Accordingly, the invention is intended to embrace all such alternatives, modifications, and variations that fall within the scope and spirit of the appended claims.

What is claimed is:

1. A suspended play structure comprising:

a support structure configured to support up to about 250 pounds when hung from an external support, the support structure comprising:

an upper ring structure and a lower ring structure;

a removable cushion that provides support for the user;

a sidewall suspended between the upper ring structure and the lower ring structure and formed of a flexible material, the sidewall including a roof, a floor, and walls defining an interior space of sufficient size for at least two individuals, the walls being collapsible so that the suspended play structure may be collapsed when the upper ring and the lower ring are brought together, the removable cushion being within or on the floor;

a hanging ring attached to the roof on the outside of the interior space from which the play structure may be hung from the external support; and a plurality of support straps embedded within or attached to the roof, the walls, and the floor.

2. The suspended play structure of claim 1, wherein the support straps are formed of nylon webbing.

3. The suspended play structure of claim 1, wherein the sidewall is formed of canvas or nylon.

4. The suspended play structure of claim 1, wherein the removable cushion includes polyester filling.

5. The suspended play structure of claim 1, further comprising removable LED lights located within the interior space.

6. The suspended play structure of claim 5, wherein the LED lights are suspended from the upper ring structure.

7. The suspended play structure of claim 5, wherein the LED lights are formed of a string of lights and further includes a battery pack and an on/off switch.

8. The suspended play structure of claim 1, wherein the sidewall includes one or more openings that form a window or door for entry or exit from the interior space.

9. The suspended play structure of claim 1, wherein the upper ring structure and the lower ring structure are inserted into sleeves attached to the sidewall.

10. The suspended play structure of claim 1, wherein the sidewall is collapsible for storage.

11. The suspended play structure of claim 1, wherein the upper ring structure and the lower ring structure are formed of metal or plastic.

12. The suspended play structure of claim 1, further comprising a metal stand from which the hanging ring is suspended.

13. The suspended play structure of claim 1, wherein the floor includes an internal pocket which contains the removable cushion.

14. The suspended play structure of claim 1, wherein the upper ring and the lower ring are each formed of two arc-shaped pieces that fit together to form each ring.

15. A suspended play structure comprising:

a support structure configured to support up to about 250 pounds when hung from an external support, the support structure comprising:

an upper ring structure and a lower ring structure;

a removable cushion that provides support for the user;

a sidewall suspended between the upper ring structure and the lower ring structure and formed of a flexible material, the sidewall including a roof, a floor, and walls defining an interior space of sufficient size for at least two individuals, the walls being collapsible so that the suspended play structure may be collapsed when the upper ring and the lower ring are brought together, the floor including an internal pocket which contains the removable cushion;

a hanging ring attached to the roof on the outside of the interior space from which the play structure may be hung from the external support; and a plurality of support straps embedded within or attached to the roof, the walls, and the floor; and a string of LED lights suspended from the upper ring structure.

* * * * *